US007922299B2

(12) United States Patent
Einat et al.

(10) Patent No.: US 7,922,299 B2
(45) Date of Patent: Apr. 12, 2011

(54) INK JET PRINTING METHOD AND APPARATUS

(76) Inventors: Moshe Einat, Ariel (IL); Nissim Einat, Shoham (IL)

( * ) Notice: Subject to any disclaimer, the term of this patent is extended or adjusted under 35 U.S.C. 154(b) by 0 days.

(21) Appl. No.: 10/566,481

(22) PCT Filed: Aug. 1, 2004

(86) PCT No.: PCT/IL2004/000706

§ 371 (c)(1),
(2), (4) Date: Jan. 31, 2006

(87) PCT Pub. No.: WO2005/009734

PCT Pub. Date: Feb. 3, 2005

(65) Prior Publication Data

US 2006/0256168 A1 Nov. 16, 2006

Related U.S. Application Data

(60) Provisional application No. 60/491,245, filed on Jul. 31, 2003.

(51) Int. Cl.
*B41J 2/05* (2006.01)
*B41J 2/155* (2006.01)
*B41J 2/17* (2006.01)

(52) U.S. Cl. ..... 347/65; 347/42; 347/84

(58) Field of Classification Search ..... 347/85, 347/40–42

See application file for complete search history.

(56) References Cited

U.S. PATENT DOCUMENTS

| | | | | |
|---|---|---|---|---|
| 3,946,398 | A | 3/1976 | Kyser et al. | |
| 4,683,481 | A | 7/1987 | Johnson | |
| 5,010,354 | A * | 4/1991 | Cowger et al. | 347/87 |
| 5,025,271 | A * | 6/1991 | Baker et al. | 347/87 |
| 5,339,102 | A | 8/1994 | Carlotta | |
| 5,581,284 | A * | 12/1996 | Hermanson | 347/43 |
| 5,760,808 | A | 6/1998 | Wiedemer | |
| 6,390,578 | B1 * | 5/2002 | Koitabashi et al. | 347/7 |
| 6,652,068 | B2 * | 11/2003 | Hsu et al. | 347/42 |
| 2001/0012039 | A1 | 8/2001 | Kanaya et al. | |
| 2001/0040610 | A1 * | 11/2001 | Kurata et al. | 347/85 |
| 2001/0043256 | A1 | 11/2001 | Seccombe et al. | |
| 2005/0018011 | A1 * | 1/2005 | Nelson | 347/40 |

FOREIGN PATENT DOCUMENTS

| | | |
|---|---|---|
| EP | 0294172 | 12/1988 |
| EP | 0830944 | 3/1998 |
| EP | 1197335 | 4/2002 |
| JP | 05-261906 | 10/1993 |
| WO | WO 03/013863 | 2/2003 |

OTHER PUBLICATIONS

Invitation to Pay Additional Fees. IPRP CH I Jan. 29, 2009.
International Search Report Dated Jul. 7, 2008 From the International Searching Authority Re.: Application No. PCT/IL04/00706.
Written Opinion Dated Jul. 7, 2008 From the International Searching Authority Re.: Application No. PCT/IL04/00706.
Communication Pursuant to Article 94(3) EPC Dated Apr. 14, 2010 From the European Patent Office Re.: Application No. 04745046.5.

* cited by examiner

*Primary Examiner* — Matthew Luu
*Assistant Examiner* — Lisa M Solomon

(57) ABSTRACT

An ink jet print head comprises a print head matrix having nozzles for drop|| formation and release opening onto a print side surface of said matrix and individual local micro-reservoirs, each associated with the local nozzles. The reservoirs open onto an ink supply surface of the matrix and are supplied with ink by capillary action from wiping or spraying of ink regularly refreshed onto the ink supply surface. The design allows for a print head that substantially covers the area of the print media and thus permits stationary printing. Printing is rapid and the ink supply arrangement allows for reliable ink supply at atmospheric pressure.

6 Claims, 29 Drawing Sheets
(9 of 29 Drawing Sheet(s) Filed in Color)

INK JET PRINTING METHOD AND APPARATUS

RELATED APPLICATIONS

This application is a National Phase Application of PCT Application No. PCT/IL2004/000706 having International Filing Date of Aug. 1, 2004, which claims priority from U.S. Provisional Patent Application No. 60/491,245, filed on Jul. 31, 2003. The contents of the above Applications are all incorporated herein by reference.

FIELD AND BACKGROUND OF THE INVENTION

The present invention relates to an ink jet printing method and apparatus.

General Background to Inkjet Printing

Ink-jet printing is a non-impact dot-matrix printing technology in which droplets of ink are jetted from a small aperture directly onto a specified position on a medium, typically paper, to create an image. The mechanism by which a liquid stream breaks up into droplets was described by Lord Rayleigh in 1878. In 1951, Elmqvist of Seimens patented the first practical Rayleigh break-up ink-jet device. The development led to the introduction of the Mingograph, one of the first commercial ink-jet chart recorders for analog voltage signals. In the early 1960s, Dr. Sweet of Stanford University demonstrated that by applying a pressure wave pattern to an orifice, the ink stream could be broken into droplets of uniform size and spacing. When the drop break-off mechanism was controlled, an electric charge could be impressed on the drops selectively and reliably as they formed out of the continuous ink stream. The charged drops were deflected into a gutter by the electric field and were then recirculated. The uncharged drops were left to fly directly onto the media to form an image. The printing process described above is known as continuous ink-jet. By the late 1960s, Sweet's inventions led to the introduction of the A. B. Dick VideoJet and Mead DIJIT products. In the 1970s, IBM licensed the technology and launched a massive development program to adapt continuous ink-jet technology for their computer printers. The resulting IBM 4640 ink-jet printer was introduced in 1976 as a word processing hardcopy-output peripheral application.

At approximately the same time, Professor Hertz of the Lund Institute of Technology in Sweden and his associates independently developed several continuous ink-jet techniques that had the ability to modulate ink-flow characteristics for gray-scale ink-jet printing. One of Professor Hertz's methods of obtaining gray-scale printing was to control the number of drops deposited in each pixel. By varying the number of drops laid down, the ink volume in each pixel was controlled, thereby adjusting the density in each color to create the gray tone desired. The method produced commercial high-quality color images for the computer prepress color hardcopy market While continuous ink-jet development was intense, the development of a drop-on-demand ink-jet method was also popularized. A drop-on-demand device ejects ink droplets only when they are used in imaging on the media. The on-demand approach eliminates the need for drop charging and deflection hardware, and also does away with inherently unreliable ink recirculation systems.

Zoltan, and Kyser & Sears, are among the pioneer inventors of the drop-on-demand ink-jet systems. Their inventions were used in the Seimens PT-80 serial character printer (1977) and by Silonics (1978). In these printers, on the application of voltage pulses, ink drops are ejected by a pressure wave created by the mechanical motion of a piezoelectric ceramic.

Many of the drop-on-demand ink-jet ideas and systems were invented, developed, and produced commercially in the 1970s and 1980s. The simplicity of the drop-on-demand ink-jet system was supposed to make ink-jet technology more reliable. However, during this period, the reliability of ink-jet technology remained poor. Problems such as nozzle clogging and inconsistency in image quality plagued the technology.

In 1979, Endo and Hara of Canon invented a drop-on-demand ink-jet method where ink drops were ejected from the nozzle by the growth and collapse of a water vapor bubble on the top surface of a small heater located near the nozzle. Canon called the technology the bubble jet The simple design of a bubble jet printhead, along with its semiconductor compatible fabrication process, allowed printheads to be built at low cost with high nozzle packing density. Apparently, during the same time period or shortly thereafter, Hewlett-Packard independently developed a similar ink-jet technology.

In 1984, Hewlett-Packard commercialized the ThinkJet printer, the first successful low-cost ink-jet printer based on the bubble jet principle, and named the technology thermal ink-jet. The cost of a ThinkJet printhead consisting of 12 nozzles was low enough that the printhead could be replaced every time the ink cartridge was empty. By replacing the print head each time, they had solved the reliability problem of ink-jet technology. Since then, Hewlett-Packard and Canon have continuously improved on the technology, and ink-jet printer models with higher printing resolution and color capability became available over the course of time at affordable prices. Since the late 1980s, because of their low cost, small size, quietness, and particularly their color capability, the thermal ink-jet or bubble jet printers became the viable alternative to impact dot-matrix printers for home users and small businesses. Currently, thermal ink-jet printers dominate the low-end color printer market.

Technology Map

Reference is now made to FIG. 1, which is a basic technology map that summarizes the various ink-jet technologies that are available. Ink-jet printing has been implemented in many different designs and has a wide range of potential applications. As shown in the figure, ink-jet printing is divided into the continuous and the drop-on-demand ink-jet methods.

Depending on the drop deflection methodology, the continuous ink-jet can be designed as a binary or multiple deflection system. In a binary deflection system, the drops are either charged or uncharged. The uncharged drops are allowed to fly directly onto the media, while the charged drops are deflected into a gutter for recirculation. In a multiple deflection system, drops are charged and deflected to the media at different levels. The uncharged drops fly straight to a gutter to be recirculated. This approach allows a single nozzle to print a small image swath. Both of these methods are widely used in the industrial coding, marking, and labeling markets. Products demonstrated include a 16.4 ft billboard size ink-jet printer that uses continuous ink-jet technology.

The majority of activity in ink-jet printing today, however, is in the drop-on-demand methods. Depending on the mechanism used in the drop formation process, the technology can be categorized into four major methods: thermal, piezoelectric, electrostatic, and acoustic. Most, if not all, of the drop-on-demand ink-jet printers on the market today use either the thermal or piezoelectric principle. Both the electrostatic ink-jet and acoustic ink-jet methods are still in the development stage with many patents pending and few commercial products available.

The thermal ink-jet method was not the first ink-jet method implemented in a product, but it is the most successful method on the market today. Two basic nozzle types are known for the thermal ink-jet, shown respectively in FIGS. 2 and 3. FIG. 2 shows the kind of nozzle known as a roof-shooter. In roof shooter nozzle 10, an orifice 12 for expulsion of droplet 14, is located above heater 16, where the upward direction is defined as being perpendicular to the plane in which the heater lies. In FIG. 3, an alternative nozzle, known as a side-shooter is shown. In the side shooter nozzle 18, an orifice 20 is located on a side near to heater 22, and substantially along the principle plane of the heater.

Reference is now made to FIG. 4, which is a simplified diagram illustrating four modes of a piezoelectric ink jet method. The heater of the nozzles of FIGS. 2 and 3 may be replaced by a piezoelectric crystal, which deforms in order to expel a drop of ink. Any one of four different piezoceramic deformation modes may be used, allowing the technology to be classified into four main types: squeeze, bend, push, and shear. The figure shows plus, zero and minus positions for three types of deformation, length and width, radial and shear.

Squeeze-mode ink-jet nozzles have been designed with a thin tube of piezoceramic surrounding a glass nozzle, and with a piezoceramic tube cast in plastic that encloses the ink channel. One version comprises a printhead array of twelve jets and an innovative maintenance station design. Subsequent efforts to introduce a second-generation printhead with a 32-jet array encountered difficulty in achieving jet-to-jet uniformity.

Reference is now made to FIG. 5, which is a simplified diagram illustrating a piezoelectric nozzle based on bend mode. In nozzle 30, one or more piezoceramic plates 32 are bonded to a diaphragm 34. The plates and the diaphragm together form an array of bilaminar electromechanical transducers which are used to eject ink droplets 36 via an orifice 38.

Reference is now made to FIG. 6, which is a simplified diagram showing a piezoelectric based nozzle for an ink jet printer which is based on a push-mode design. In nozzle 40, a piezoceramic rod pushes against diaphragm 44 at a point of contact 46 referred to as a foot. As the rod expands, under the influence of an excitation signal, it pushes the diaphragm against ink within the nozzle to eject droplets 48 via orifice 50. It will be appreciated that whilst a single rod is shown for simplicity, a practical nozzle may include a plurality of rods. In theory, piezodrivers, as the rods are referred to, can directly contact and push against the ink. However, in practice, the diaphragm is incorporated between the piezodrivers and the ink to prevent any undesirable interactions between ink and piezodriver materials.

In both the bend- and push-mode designs, the electric field generated between the electrodes is in parallel with the polarization of the piezoelectric material. Reference is now made to FIG. 7 which shows a nozzle for a shear-mode printhead. In shear mode nozzle 52 the electric field is designed to be perpendicular to the polarization of piezodriver 54. The shear action deforms the piezodrivers against the ink to eject the droplets 56 via orifice 58. In nozzle 52, the piezodriver becomes an active wall of ink chamber 60. Interaction between ink and piezomaterial is one of the key parameters of a shear-mode printhead design.

Printhead Design and Fabrication Processes.

Today the ink-jet technologies most active in laboratories and in the market are the thermal and piezoelectric drop-on-demand ink-jet methods. In a basic configuration, a thermal ink-jet consists of an ink chamber having a heater with a nozzle nearby. Reference is now made to FIGS. 8*a* . . . 8*c* which show three phases in the operation of such a basic configuration. In a first stage, FIG. 8*a*, a current pulse having a duration of less than a few microseconds is applied to heater 62, so that heat is transferred from the surface of the heater to ink 64 lying in chamber 66. The ink becomes superheated to the critical temperature for bubble nucleation. For water-based ink, the critical temperature is around 300° C. FIG. 8*b* shows nucleation occurring, wherein a water vapor bubble instantaneously expands to force ink out of the nozzle. Once all the heat stored in the ink is used, the bubble begins to collapse on the surface of the heater. Concurrently with the bubble collapse, the ink droplet breaks off as shown in FIG. 8*c* and accelerates towards the paper. The whole process of bubble formation and collapse typically takes place in less than 10 μs. The chamber is then replenished with ink and the process is ready to begin again. Depending on the channel geometry and the physical properties of the ink, the ink refill time can be from 80 to 200 μs.

Reference is now made to FIG. 9, which is a graph illustrating the process shown in FIG. 8 by plotting various parameters of the process including electrical pulse, temperature, pressure, and bubble volume against a common time axis. The graph shows the various pressure, temperature, and bubble volume changes during a thermal ink-jet drop formation cycle.

FIG. 10 shows a scanning electron microscope (SEM) photograph of a thermal ink-jet channel with heater and ink barrier layer. The jet supplied by the device in the photograph is known to produce ink droplets at the rate of 6000 drops per second. The ink channel in the SEM photograph measures approximately 0.025 mm thickness and a little more in width. However, the dimensional stability, accuracy, and uniformity of the channel are known to have significant effects on various performance features of the jet such as drop frequency, volume, and velocity. All of the performance parameters together ultimately determine the quality and throughput of the final printed image. The trends in the industry are currently to provide smaller droplets for image quality, faster drop frequency, and a higher number of nozzles for print speed, while the cost of manufacture is reduced.

The above manufacturing trends force further miniaturization of the ink-jet design. Consequently, the reliability issue becomes critical. In a recent generation of one popular ink jet series, a 192-nozzle tricolor printhead that can jet much smaller ink droplets (10 pl) at the rate of 12,000 drops per second was introduced. Ink feeds from both sides of the heater chamber. The fluid architecture significantly reduces the possibility of nozzle clogging from particulates. Particulates may for example have been trapped in the printhead fabrication processes or may be left in the ink from the ink manufacturing process. A row of small openings between the ink manifold and the heater chamber was also introduced into the design, in order to improve the reliability of the printhead.

Another trend in the industry is market demand for lower cost per print. Printhead producers can pack in greater ink volume per cartridge to increase the print count or install a permanent or semipermanent thermal printhead to reduce the cost of new ink cartridges. Again, such a trend demands even higher reliability for thermal ink-jet printheads.

Another popular model currently on the market comprises a 480-nozzle printhead. In the implementation, the 480-nozzle printhead consists of six colors with 80 nozzles per color.

Reference is now made to FIG. 11, which is a simplified diagram illustrating a piezoelectric print head comprising a piezoelectric nozzle 70 as discussed above. In the piezoelectric drop-on-demand ink-jet method, deformation of the piezoceramic material 72 causes the ink volume change in the pressure chamber to generate a pressure wave that propagates toward the nozzle 70. The acoustic pressure wave overcomes the pressure loss due to viscosity typical of a small nozzle. The wave also overcomes the surface tension force from the ink meniscus that forms so that an ink drop can begin to form at the nozzle. When the drop is formed, a pressure sufficient to expel the droplet toward a recording media must be exerted. The basic pressure requirements are shown in FIG. 12, which illustrates three different stages of drop formation, equivalent to the three stages shown in FIG. 8. At each stage a corresponding pressure is noted.

In general, the deformation of a piezoelectric driver is on the submicron scale. To have large enough ink volume displacement for drop formation, the physical size of a piezoelectric driver is often much larger than the ink orifice. Therefore, miniaturization of the piezoelectric ink-jet printhead has been a challenging issue for many years.

Independently from the thermal or piezo ink-jet method, bend or shear mode, one of the most critical components in a printhead design is its nozzle. Nozzle geometry such as diameter and thickness directly effects drop volume, velocity, and trajectory angle. Variations in the manufacturing process of a nozzle plate can significantly reduce the resulting print quality. Image banding is a common result from an out-of-specification nozzle plate. The two most widely used methods for making the orifice plates are electroformed nickel and laser ablation on the polyimide. Other known methods for making ink-jet nozzles are electro-discharged machining, micropunching, and micropressing.

Because smaller ink drop volume is required to achieve higher resolution printing, the nozzle diameter of printheads has become increasingly small. With the trends towards smaller diameters and lower cost, the laser ablation method has become popular for making ink-jet nozzles.

Print Head Registration and Lifetime Issues

Ink jet printing uses small nozzles as described above, that eject ink drops towards the print medium. The image is thus made of a huge number of ink drops—wherein the ink drop lands on the print medium. Each dot represents a pixel. The number of pixels or ink drops is very large compared to the number of ink jet nozzles, meaning that the firing frequency, the number of drops ejected per second, is very high. Typically around 10,000 drops per second are ejected from each nozzle during operation of a typical home ink jet printer. In addition there is a need to place the drops on the medium in a correct and very precise way in order to provide a good quality print image.

A typical way of transferring the ink is to mount the print head on a carriage and perform print scans back and forth over the print medium. During these print scans the location of the print head is determined precisely by encoders and the ink drops are placed on the medium as required.

Another way of transferring the ink to the print medium is to use the so-called full array method, concerning which see U.S. Pat. No. 4,477,823, the contents of which are hereby incorporated by reference. In the full array method a one-dimensional array is created such that there is full coverage of the pixels in one print line so that each nozzle relates to one pixel. Creating such a one-dimensional "full array" may be accomplished by a 2-D array due to the practical difficulties of building the necessary nozzle density in a single line.

With such a one-dimensional array, there is no need to mount the print head on a carriage since no side-to-side motion is needed. Furthermore due to the lack of side-to-side scanning, a much faster print speed is possible. Yet, the paper still needs to advance lengthwise for the next print line and thus there is still overall relative movement between the print medium and the nozzles, a fact that has inherent problems as will be described hereinbelow.

Ink Supply Issues

In order to eject the ink drops, ink channels supply ink to the print head from a main reservoir. In order to facilitate the supply, the pressure of the ink inside the ink jet nozzle has to be well regulated in order to achieve constant drop volume. Moreover, the ink pressure in the print heads used today is slightly lower than atmospheric pressure. These pressure conditions are crucial for drop ejection. The negative pressure is obtained by regulating the pressure inside the main reservoir using various methods such as pressure pumps, placing the reservoir below the print head, or capillary foam. Further details may be found in U.S. Patent Application No. 2001/043256, the contents of which are hereby incorporated by reference. Reference is made once again to FIG. 6, which shows how a drop is ejected when the pressure of trapped ink rises dramatically inside the ink chamber due to operation of the piezoelectric actuator 42.

The number of ink jet nozzles in a drop-on-demand print head is generally a few dozen, and the firing frequency is about 10,000 drops per second, implying that a very large number of drops are ejected in a single second for each one of the nozzles, leading to significant wear on the nozzle and the ejection mechanism.

The market demand is for faster printers with better print quality. To achieve faster printing it is necessary to increase the number of drops ejected per second. This can be done by raising the firing frequency and by enlarging the number of nozzles and indeed this is the technological trend in ink jet development. The trend is exemplified by International Patent Application No. WO03013863, the contents of which are hereby incorporated by reference. Printing at higher frequency dictates a faster movement between the ink jet nozzles and the print medium. This faster movement, naturally, is harder to control and the printer has to be more complex in order to support the movement of the carriage or the print medium. Achieving these two goals, that is higher firing frequency and greater number of nozzles, is inherently limited with the current ink jet technology as explained in the following.

Inherent printing problems of ink jet technology.

1. Chronic loss of operating nozzles: it is a common problem that while printing, some of the nozzles fail, that is they stop ejecting drops. In order to produce a drop, strict pressure and flow conditions inside the ink chamber part of the nozzle have to be maintained. Such maintenance can be problematic when both the number of ink jet nozzles and the firing frequency are increased.

Some of the factors that are responsible for the loss of operating nozzles are:

- Sensitivity to vibrations, and to the acceleration and deceleration that are experienced when the print head carriage moves whilst printing. The faster the print head moves the worse such problems become and, as mentioned, a higher firing frequency dictates a faster print scan.
- Air bubbles become trapped inside the ink supply system. Due to the physics of drop ejection, small air bubbles can penetrate into the ink jet nozzle and ink supply system. Such air bubbles can damage the ink jet nozzles' operation and ink supply.
- Rapid changes in firing frequency create pressure waves inside the ink supply system due to variable ink consumption. The pressure waves change the ink pressure inside the ink jet nozzle, however it is important that the pressure remains constant in order to eject drops properly. The problem worsens when the total number of drops per second (firing frequency+number of ink jet nozzles) is increased.

The loss of a single nozzle leads to the loss of many thousands of drops on the final image, directly impacting on the printing quality.

2. Satellite drops: Referring now to FIGS. 13 and 14, when ink drops are created by a print head they are typically not formed as single clean drops but rather as a large main drop and secondary smaller drops, also known as satellite drops. FIG. 13 is a series of photographs of drops being ejected from a nozzle. Each photograph in the series is taken at a different number of microseconds from drop ejection, and the series illustrates the evolution of main and satellite drops during the ejection process. FIG. 14 shows the effect of the main and satellite drops as the drops land on the print medium. Due to the relative motion between the print head and the print medium during printing, the main and satellite drops do not arrive at the same location on the print medium, but rather the satellite drops are displaced from the main drop landing point.

As described, conventionally, printing is carried out whilst the print head moves, that is during print scans. Because of the scan movement the main and satellite drops do not land at the same point on the print medium and this leads to undesired shapes of pixels at the printed image. Further discussion of the problem is available in European Patent Application No. 1,197,335, the contents of which are hereby incorporated by reference. The shape of the drops formed on the print medium directly influence print quality and the optimal drop shape is as round as possible. Obviously, the faster the print head moves the longer the "tail" or drop projection, on the print medium, as FIG. 14 clearly suggests.

The connection between pixel shape and print head speed implies that inherent deterioration of image quality happens precisely when increasing the speed of movement between the print head and the print medium, because of the distortion caused thereby to the drop shape. The loss of quality is irrespective of the technical difficulty of providing accurate control of the faster scan carriage.

3. Drop velocity & cross talk: As explained, printing is carried out during the course of relative movement between the print head and the print medium. Since the drop has to fly a fixed distance from the nozzle to the medium, its velocity determines the time it takes the drop to arrive at the medium. Due to the relative motion between s the print head and the print medium the time and thus the drop velocity affects the landing point of the drop on the print medium.

To make matters worse, there is an undesirable variance in drop velocity between the different nozzles within a single ink jet print head. Furthermore there is a cross-talk phenomena as well in that nozzles show a variation in their drop velocity due to operation of neighboring nozzles. The drop velocity variation is at least partly due to ink supply issues, and an ink supply method intended to reduce the problem, known as "center" feed design, is described in U.S. Pat. No. 4,683,481 to Johnson, the contents of which are hereby incorporated by reference. The disclosure, entitled "Thermal Ink Jet Common-Slotted Ink Feed Print head," describes the use of small slots in the ink manifold. The slots serves as buffers that can absorb sudden pressure variations.

4. Wet on dry phenomena: the printed image comprises different parts which are not printed simultaneously. Consequently, there are regions where there is overlap between still wet or fresh drops and dry or old drops on the print medium. The fresh and old drops have different fluid characteristics that detract from simple and straightforward mixing of the inks in order to create the intended color, for example blue & yellow to create green.

Compared to visual display technology such as liquid crystal display (LCD) screens where an image is created instantaneously, ink jet printing is very slow. There is ongoing progress in ink jet printing speed, as disclosed, for example, in pat WO03013863, the contents of which are hereby incorporated by reference. Nevertheless the basic principal of printing remains the same—a print head launches drops of ink that lend on a print medium during relative motion therebetween, the relative motion being controlled in order to ensure that a given drop lands at an intended location. Conventional ink jet printing therefore cannot be instantaneous as it is dependent on the motion of a body having mass.

There is thus a widely recognized need for, and it would be highly advantageous to have, an ink jet printing system which is devoid of the above limitations.

SUMMARY OF THE INVENTION

According to one aspect of the present invention there is provided an ink jet print head comprising a plurality of nozzles for controlled formation and release of ink drops for printing. In the print head, each nozzle is associated with a local ink storage reservoir for replenishment of the nozzle with ink. As will be explained below the local storage reservoir serves the purpose of feeding ink to at least one nozzle by capillary action. It is therefore appropriate that the local ink storage reservoir is open to environmental pressure, in contrast to conventional systems which often use pressurized systems and particularly negative pressure. As feeding of the ink is by capillary action and is independent of pressure, the ink feed mechanism ceases to provide an intrinsic limitation on the size of the print head.

The invention is applicable to the bubble jet type ink jet print head and other types of drop on demand printing.

The reservoir is dimensioned to allow capillary action to drive ink supplied to the reservoir to cross the reservoir to the nozzle. Equations are given below to explain how such dimensioning may be carried out accurately. However the sizing of the reservoirs is not limited merely to the results suggested by the equations.

The print head is preferably constructed with a feed neck between the nozzle and the reservoir, the feed neck being dimensioned to allow capillary action to drive ink supplied to the reservoir to cross the reservoir to the nozzle.

Preferably, not only the reservoir and/or feed neck dimensions are so selected but also the dimensions of the nozzle itself and the relative dimensions between the nozzle and the reservoir are selected so as to allow sufficient capillary action to drive ink supplied to the reservoir to cross the reservoir to the nozzle.

In one embodiment, each nozzle is arranged with its own respective local ink storage reservoir. Each nozzle is then connected via a neck to its own reservoir.

In an alternative embodiment, the local ink storage reservoir is a channel inserted into the print head, and the channel is preferably aligned to supply ink to a row of nozzles.

The channel embodiment may be adapted for color printing by supplying different color inks to succeeding channels along the print head. Thus the print head may comprise a plurality of color ink supply ducts, each of the color ink supply ducts connected to different ones of the channels, thereby to enable single pass color printing from the print head.

Preferably, the nozzles in the print head are arranged into a substantially rectangular printing area dimensioned to give simultaneous printing coverage of standard sized printing media.

The print head is preferably arranged for printing on the standard sized printing media during a period of unchanged or substantially unchanged relative displacement between the print head and the printing media. The term "substantially unchanged" means herein unchanged apart from a perturbation, as exemplified hereinbelow.

Preferably, each of the plurality of nozzles has an ink release mechanism, and the ink expulsion mechanism is controllable using pulses to provide different ink quantities to the print medium.

Additionally or alternatively, each of the plurality of nozzles has an ink expulsion mechanism, and the ink expulsion mechanism is controllable using pulses to provide different drop sizes or different numbers of drops to the print medium. Due to the stationary nature of the print head, successive drops from the same nozzle should arrive at the same position on the print medium. Suitable control of the ink expulsion mechanism may thus provide a printer that can print in either or both of FM and AM printing modes.

A preferred embodiment comprises a perturbation mechanism for introducing a relative perturbation between the print head and the print medium. Preferably the perturbation is smaller than a pixel density of the print head, in which case the print head is enabled to print at a higher level of resolution than that automatically available from the nozzle density.

An alternative embodiment comprises a perturbation mechanism for introducing a relative perturbation between the print head and the print medium, which perturbation is larger than a pixel density of the print head.

The nozzles and the local ink reservoirs are typically arranged within a print head matrix, the matrix having a printing surface comprising nozzle outlets and an ink supply surface opposite the ink supply surface comprising inlets to the local ink reservoirs.

Preferably the print head includes an ink distribution device associated with the ink supply surface for distributing ink to reach the local ink reservoirs.

In one embodiment, the ink distribution device is a wiper for wiping ink over the ink supply surface.

In another embodiment, the ink distribution device is a brush for brushing ink over the ink supply surface.

In a third embodiment, the ink distribution device is a sponge for sponging ink over the ink supply surface.

In a fourth embodiment, the ink distribution device is a spray device for spraying ink over the ink supply surface. The skilled person will be aware of other possibilities of delivering ink to the micro-reservoirs.

Preferably, the ink distribution device is an atmospheric pressure ink distribution device.

Preferably, the ink distribution device is a tubeless distribution device.

Typically, each nozzle has an ink ejection device for controllably releasing ink from the nozzle, and in a preferred embodiment, the ink ejection devices is connected to a matrix addressing arrangement for control thereof.

Preferably, the ejection devices are controllable via the matrix addressing arrangement to release quantities of ink for full and half tone printing dots.

Preferably, the ejection devices are controllable to print successive half tone dots at a single printing position to aggregate to a predetermined tone level.

According to a second aspect of the present invention there is provided an ink jet print head comprising a print head matrix, the matrix having a plurality of nozzles for drop formation and expulsion opening onto a print side surface of the matrix and a plurality of local reservoirs, associated with respective ones of the nozzles, opening onto an ink supply surface of the matrix.

Preferably, each one of the plurality of nozzles is arranged with its own respective local ink storage reservoir.

Preferably, the matrix is arranged into a substantially rectangular printing area dimensioned to give simultaneous printing coverage of standard sized printing media.

The matrix may be arranged for printing on the standard sized printing media during a period of unchanged or substantially unchanged relative displacement between the print head and the printing media.

It will be understood that in general, the print side surface and the ink supply surface are respectively opposite sides of the matrix.

The ink head further comprises an ink distribution device associated with the ink supply surface for distributing ink to reach the local ink reservoirs.

In one preferred embodiment, the ink distribution device is a wiper for wiping ink over the ink supply surface.

In another preferred embodiment, the ink distribution device is a spray device for spraying ink over the ink supply surface.

In a third embodiment, the ink distribution device is an atmospheric pressure ink distribution device.

In a fourth embodiment, the ink distribution device is a tubeless distribution device.

According to a third aspect of the present invention there is provided apparatus for supplying ink to ink jet nozzles, comprising:

an ink supply surface, micro-reservoirs associated with local ones of the nozzles and open to the ink supply surface, and an ink distribution device for distribution of the ink over the ink supply surface to enter the micro-reservoirs by capillary action.

Preferably, each one of the plurality of nozzles is arranged with its own respective micro-reservoir.

Preferably, the plurality of nozzles is arranged into a substantially rectangular printing area dimensioned to give simultaneous printing coverage of standard sized printing media.

Preferably, the apparatus is constructed and arranged for printing on the standard sized printing media during a period of unchanged, or substantially unchanged, relative displacement between the print head and the printing media.

Preferably, the nozzles and the micro-reservoirs are arranged within a print head matrix, the matrix having a printing surface comprising nozzle outlets and the ink supply surface is opposite the ink supply surface and comprises inlets to the micro-reservoirs.

In one embodiment, the ink distribution device is a wiper for wiping ink over the ink supply surface.

In another embodiment, the ink distribution device is a brush for brushing ink over the ink supply surface.

In a third embodiment, the ink distribution device is a sponge for sponging ink over the ink supply surface.

In a fourth embodiment, the ink distribution device is a spray device for spraying ink over the ink supply surface.

Preferably, the ink distribution device is an atmospheric pressure ink distribution device.

Preferably, the ink distribution device is a tubeless distribution device.

According to a fourth aspect of the present invention there is provided an ink jet printing head comprising a plurality of nozzles for forming and expelling ink droplets for printing onto a print medium, wherein the plurality of nozzles is arranged into a two dimensional grid substantially to be coextensive with a standard size print medium.

According to a fifth aspect of the present invention there is provided a method of ink jet printing comprising:

providing a print head having a predetermined density of nozzles over an area substantially equal to a printing area of a print medium, each of the nozzles being associated with a local micro-reservoir for ink replenishment, and whilst retaining a static relationship between the print head and the print medium, expelling ink from the nozzles towards a print medium to print over substantially all of the printing area.

The method may additionally comprise distributing ink over an ink supply surface of the print head, the ink supply surface having openings to each of the micro-reservoirs such as to allow the distributed ink to enter the micro-reservoirs by capillary action.

Preferably, retaining the static relationship comprises carrying out the simultaneously expelling ink over a duration of unchanged or substantially unchanged relative displacement between the print head and the print medium.

The method may further comprise repeating the stage of expelling ink a plurality of times, for each repetition tilting the print head by a predetermined angle.

According to a sixth aspect of the present invention there is provided a method of manufacture of a print head for ink jet printing comprising:

providing a matrix material having two major planar surfaces, introducing nozzles into the matrix having outlets to a first of the major planar surfaces, introducing micro-reservoirs into the matrix, each micro-reservoir having a first opening into a corresponding nozzle and an inlet towards a second of the major planar surfaces.

The method may further comprise providing an ink delivery system for spreading ink over the second planar surface in a quantity suitable for entering via capillary action into the micro-reservoirs.

In one embodiment, the ink delivery system comprises a wiper for wiping ink over the second planar surface.

In another embodiment, the ink delivery system comprises a spray unit for spraying ink over the second planar surface.

Preferably, the matrix has dimensions substantially to provide coverage over a standard size of printing media.

Preferably, the nozzles are introduced over a region of the matrix sized to provide printing coverage over a standard size of printing media.

According to a seventh aspect of the present invention there is provided a method of manufacture of an ink-jet printer comprising:

mounting in static manner a print head arranged with nozzles covering an area of a standard size of printing media, and mounting a print media delivery system configured to deliver print media to the vicinity of the print head and to retain the print media in a stationary mode in the vicinity for printing by the print head.

According to an eighth aspect of the present invention there is provided an ink jet print apparatus comprising a matrix print head having a two-dimensional array of nozzles and a feed apparatus for feeding a print medium to said matrix print head such that said print medium is held relatively stationary to said matrix print head.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The file of this patent contains at least one drawing executed in color photograph. Copies of this patent with color photograph(s) will be provided by the Patent and Trademark Office upon request and payment of necessary fee.

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a technology tree for bubble jet technology;

FIG. 2 is a conventional top shooter bubble jet nozzle;

FIG. 3 is a conventional side shooter bubble jet nozzle;

FIG. 4 is a simplified diagram illustrating deformation modes for an ink ejection mechanism;

FIG. 5 is a conventional piezoelectric based ink jet nozzle;

FIG. 6 is another conventional piezoelectric based ink jet nozzle;

FIG. 7 is another conventional piezoelectric based ink jet nozzle;

Figure 8A:
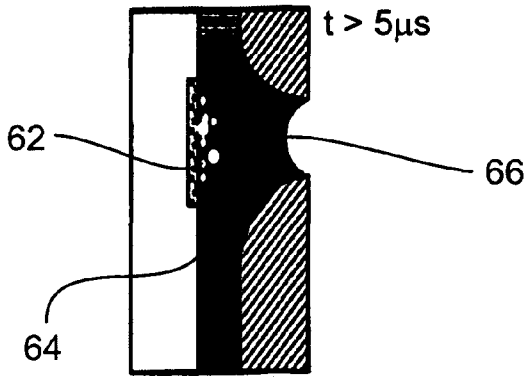
Figure 8B:
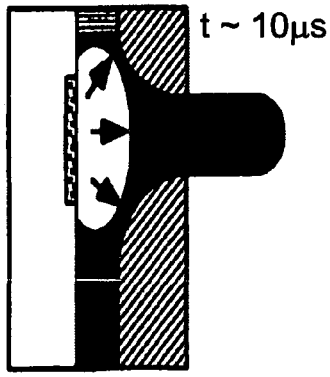
Figure 8C:
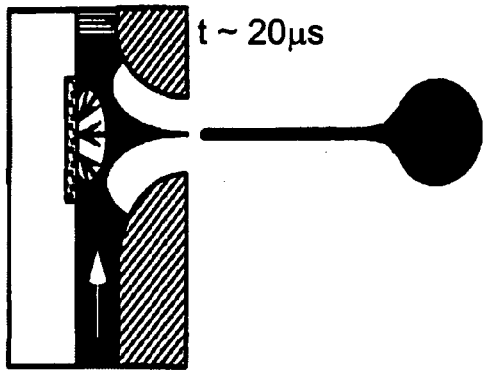
Figure 9:
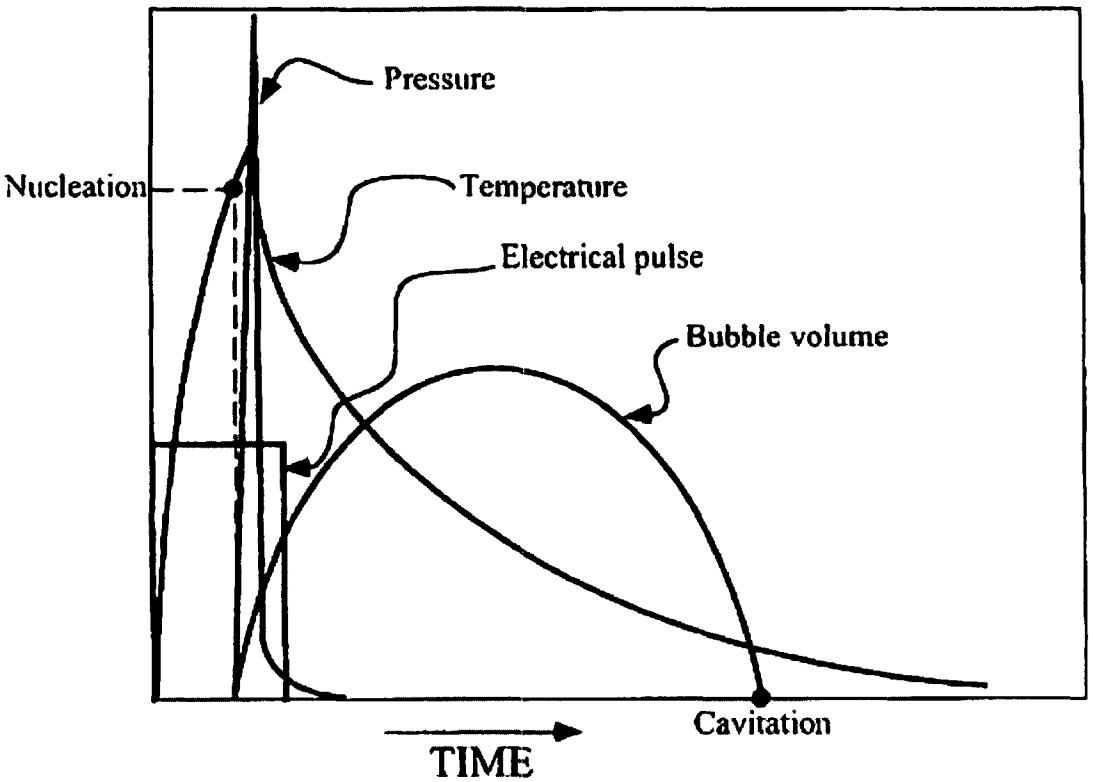
Figure 10:
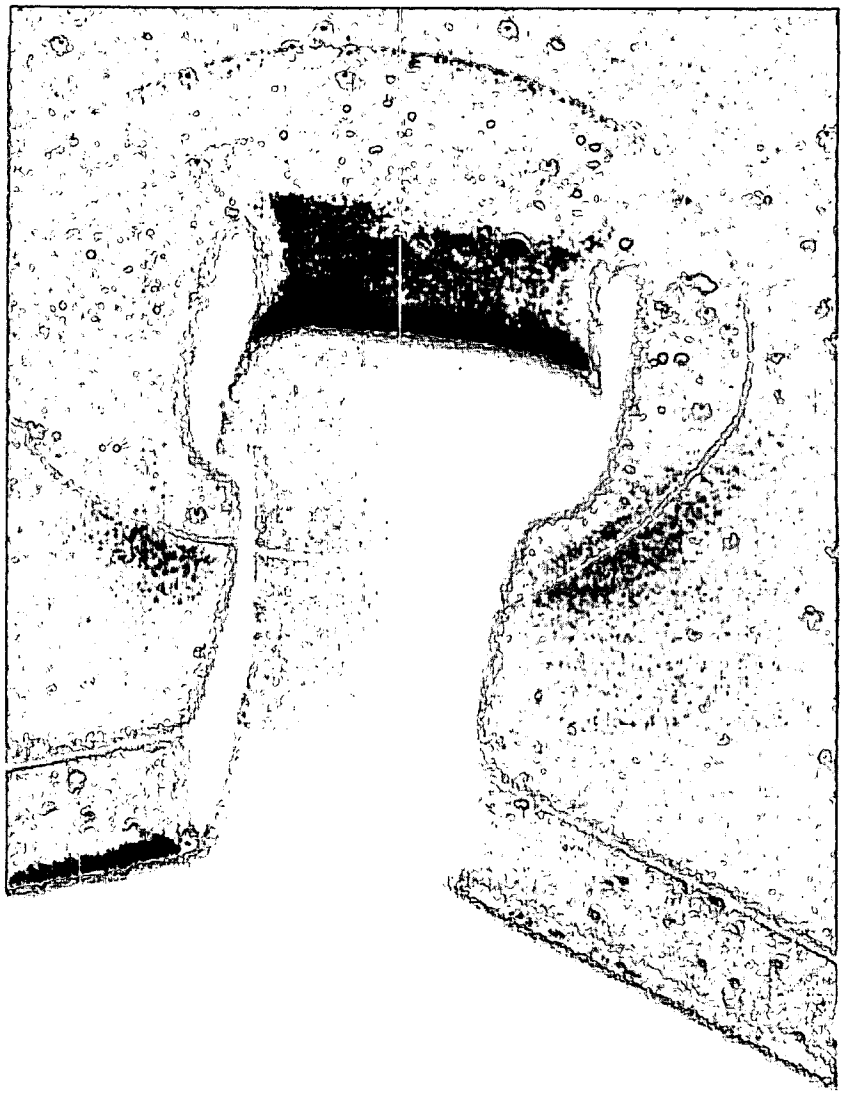
Figure 11:
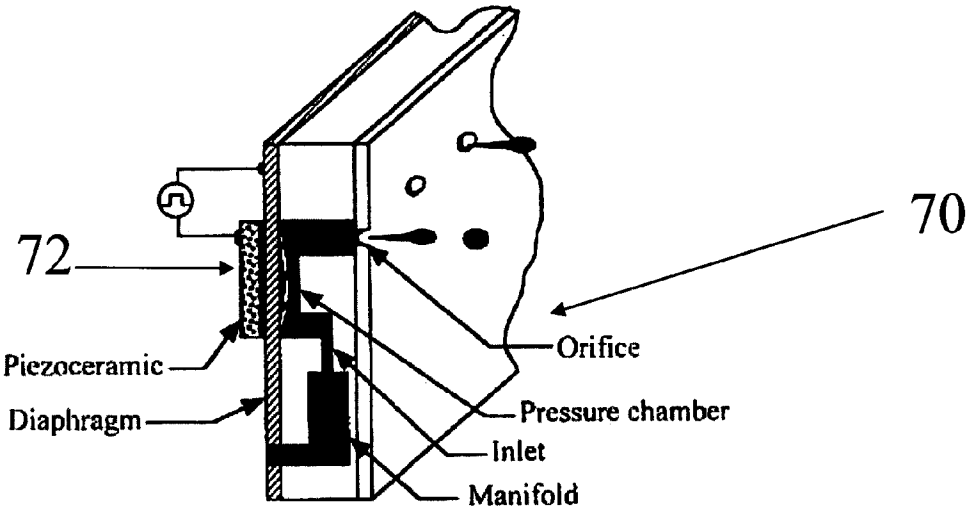
Figure 12:
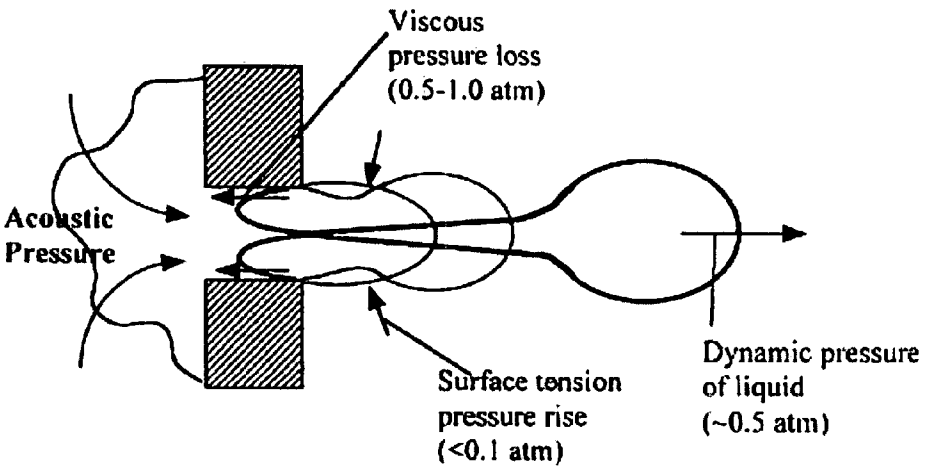
Figure 13:
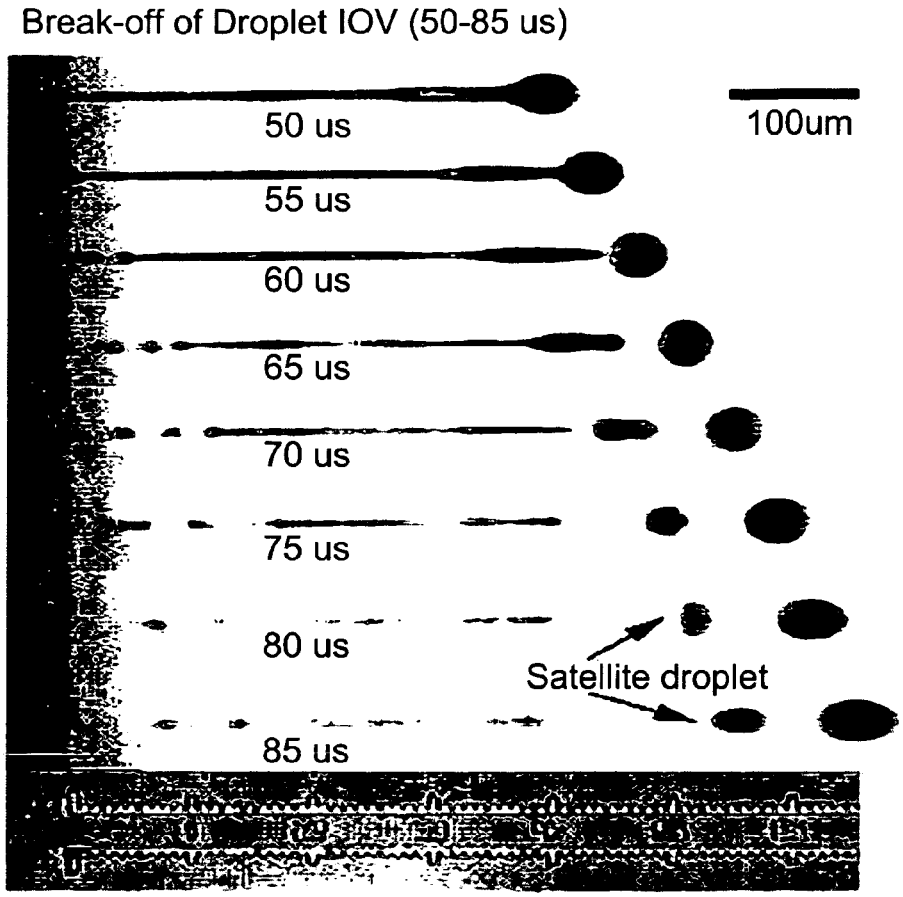
Figure 14:
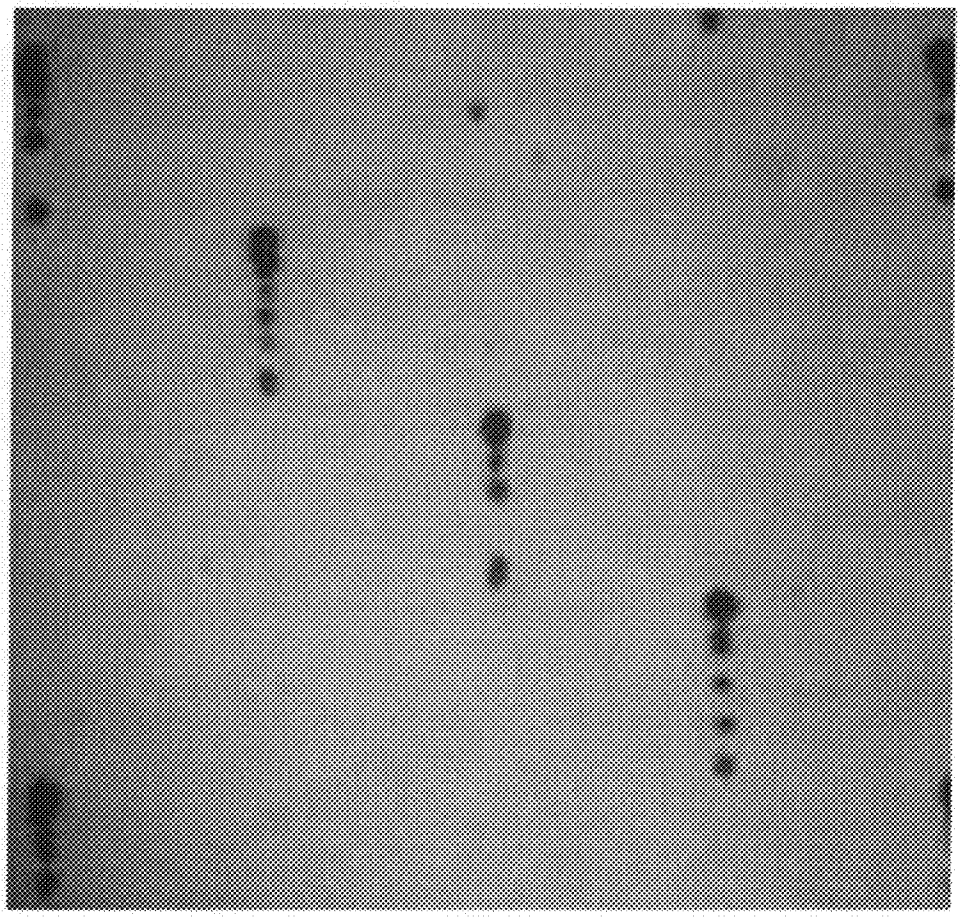
Figure 15A:
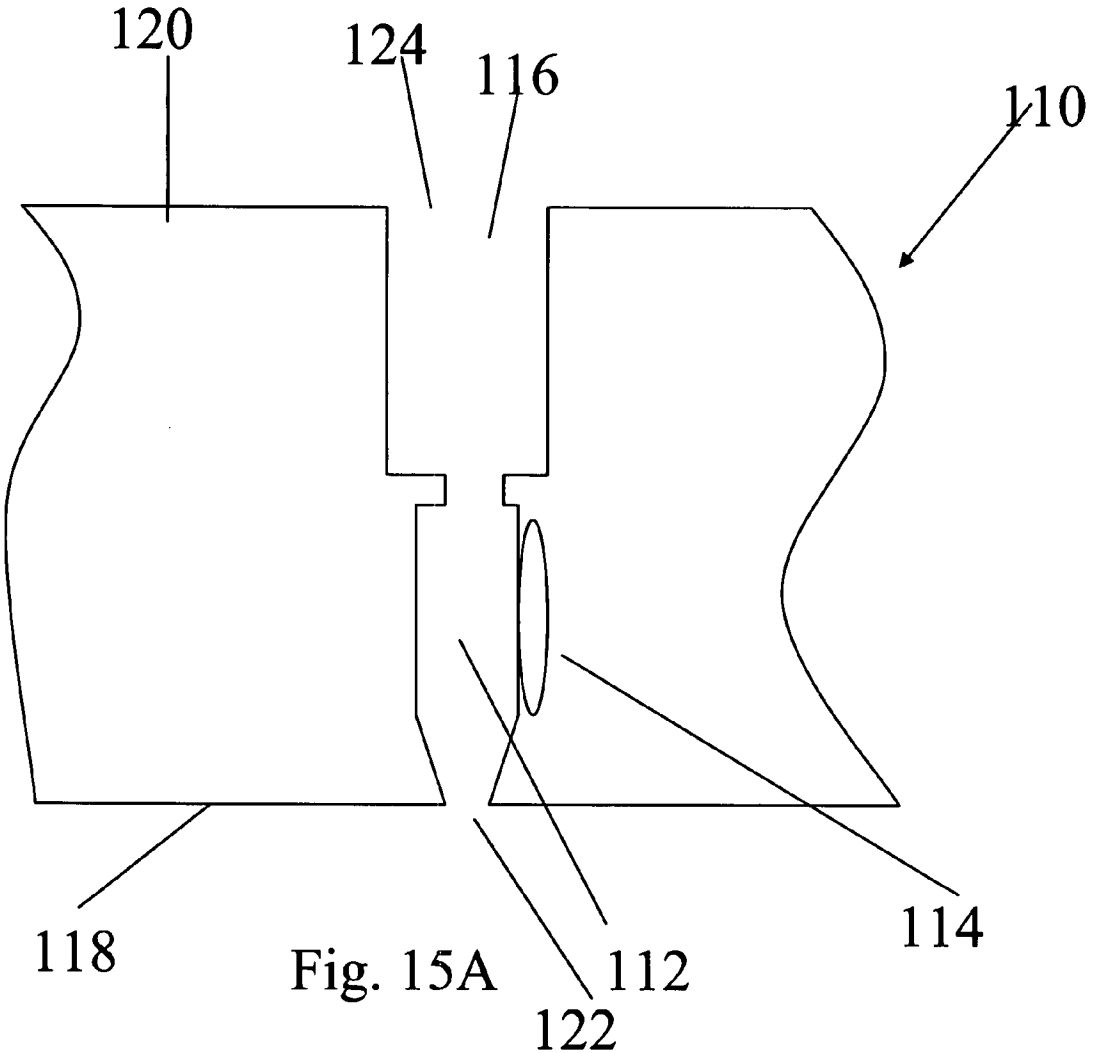
Figure 15B:
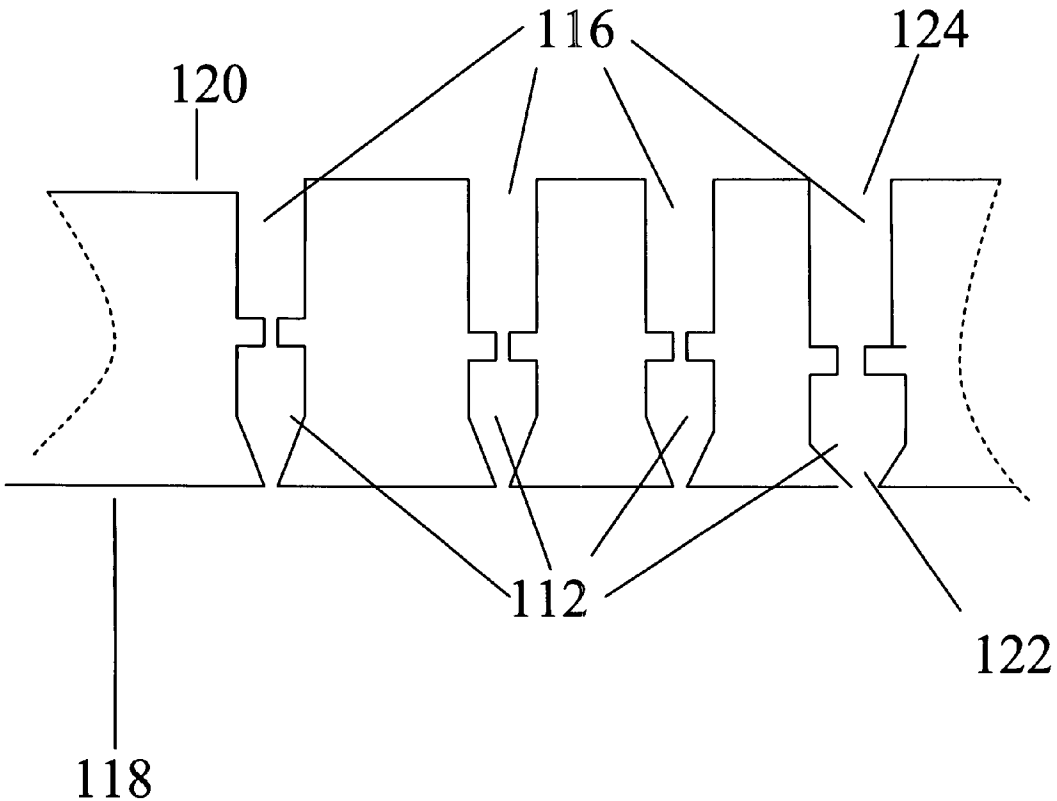
Figure 16B:
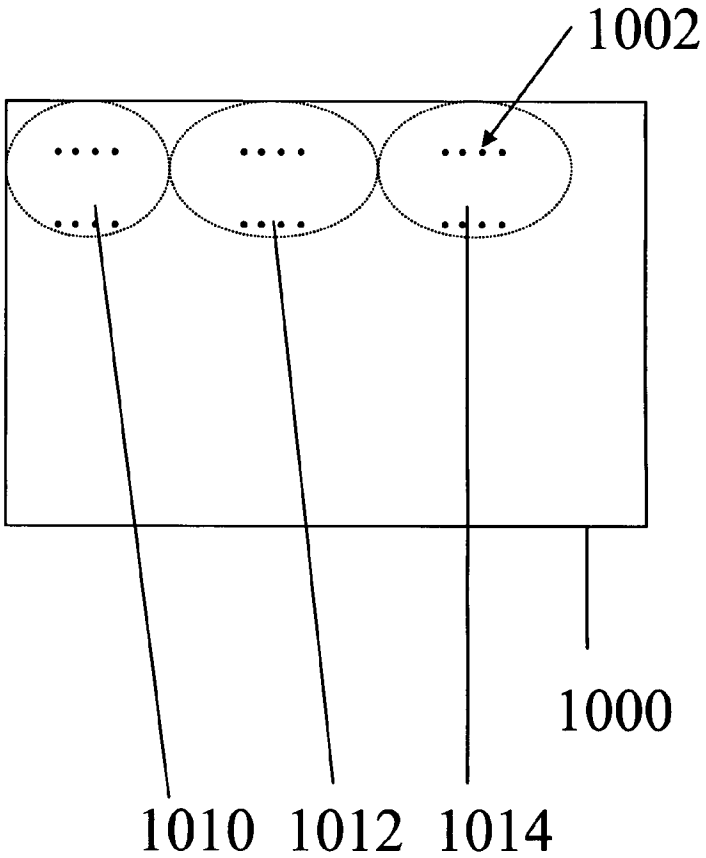
Figure 16A:
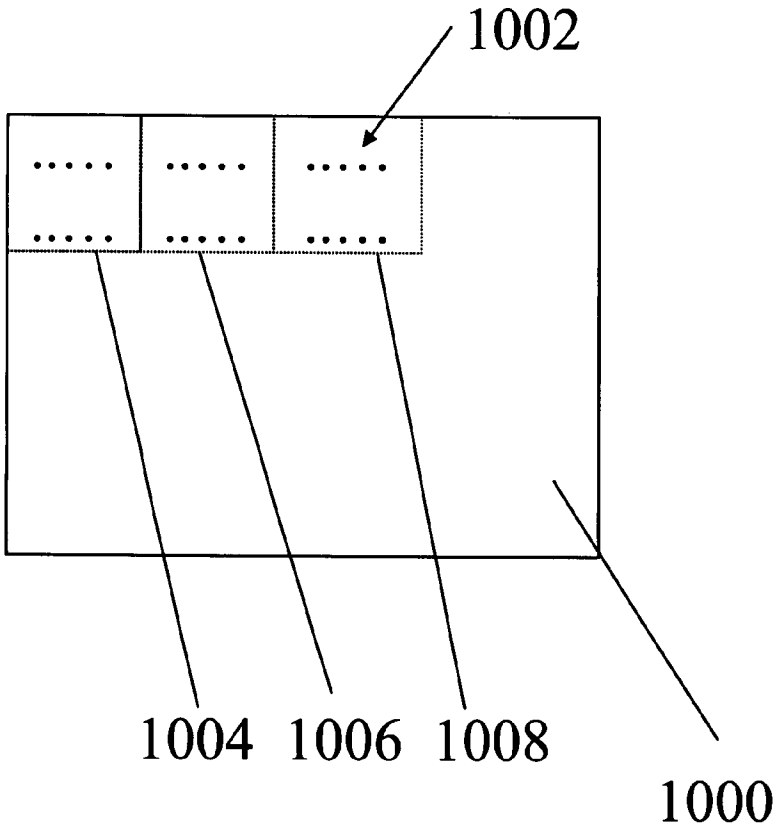
Figure 17A:
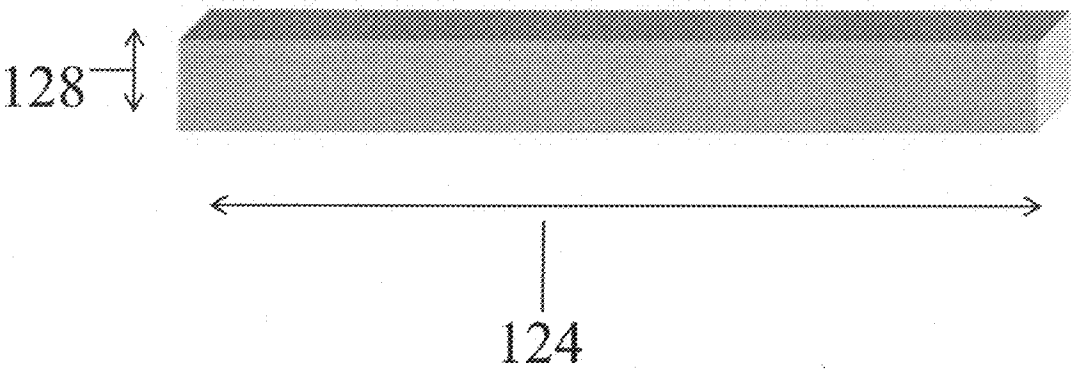
Figure 17B:
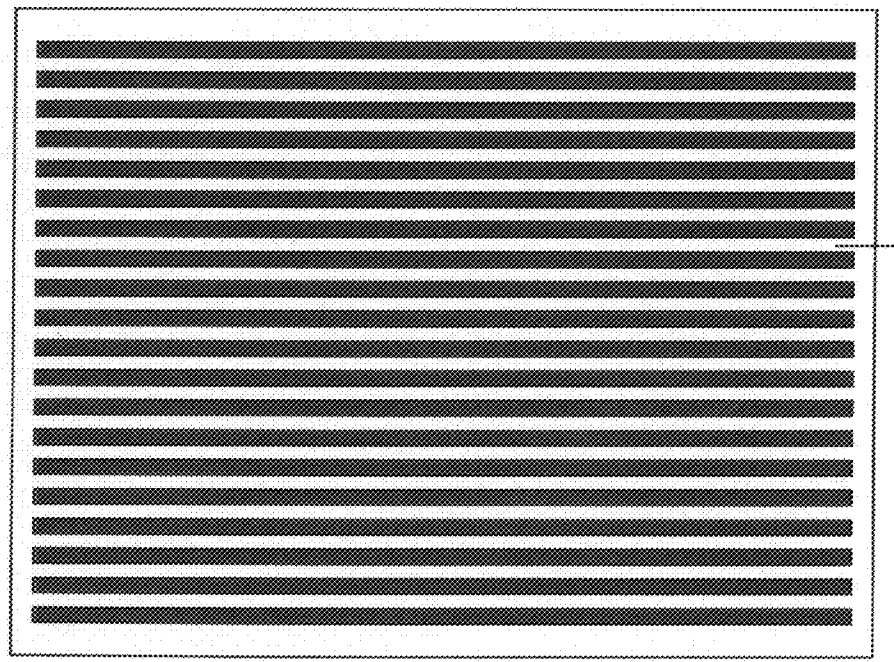
Figure 17C:
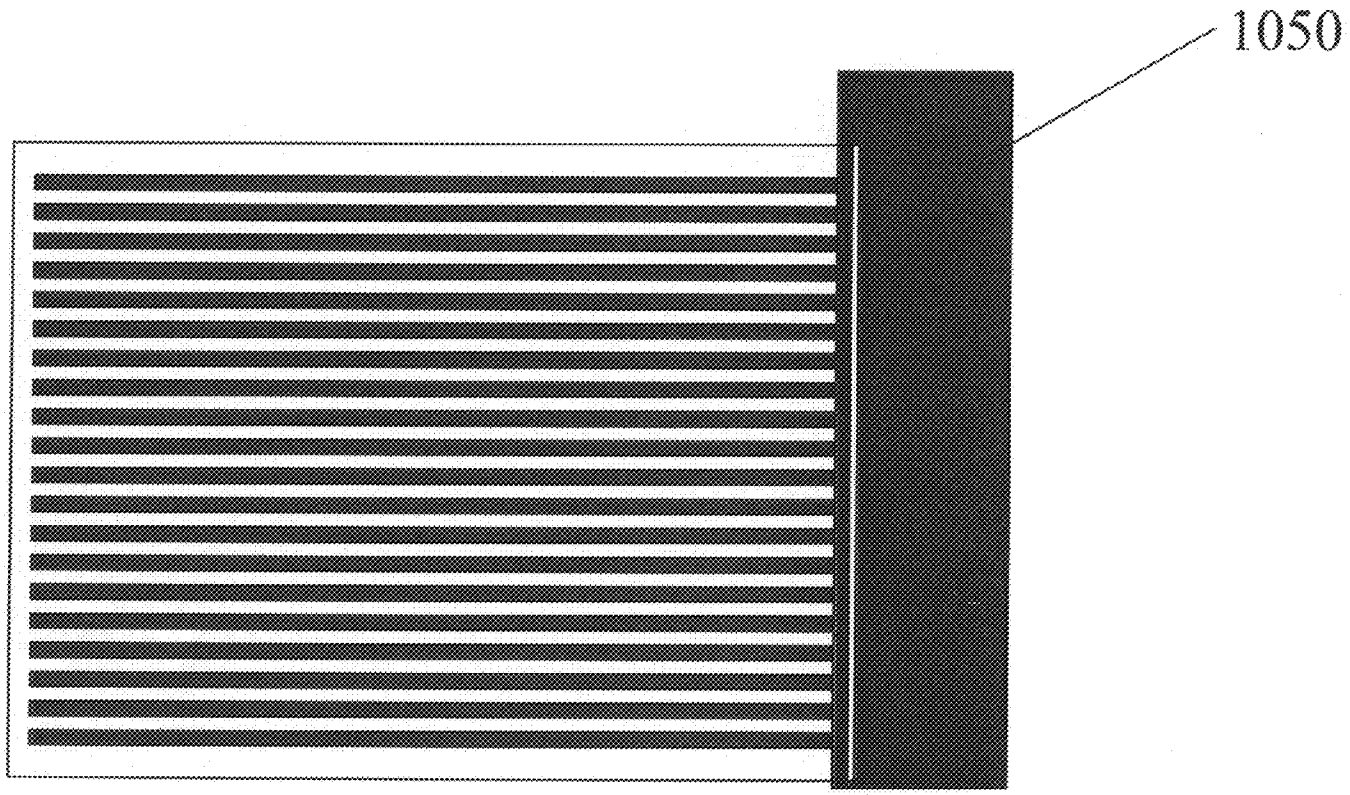
Figures 18, 19, 20:
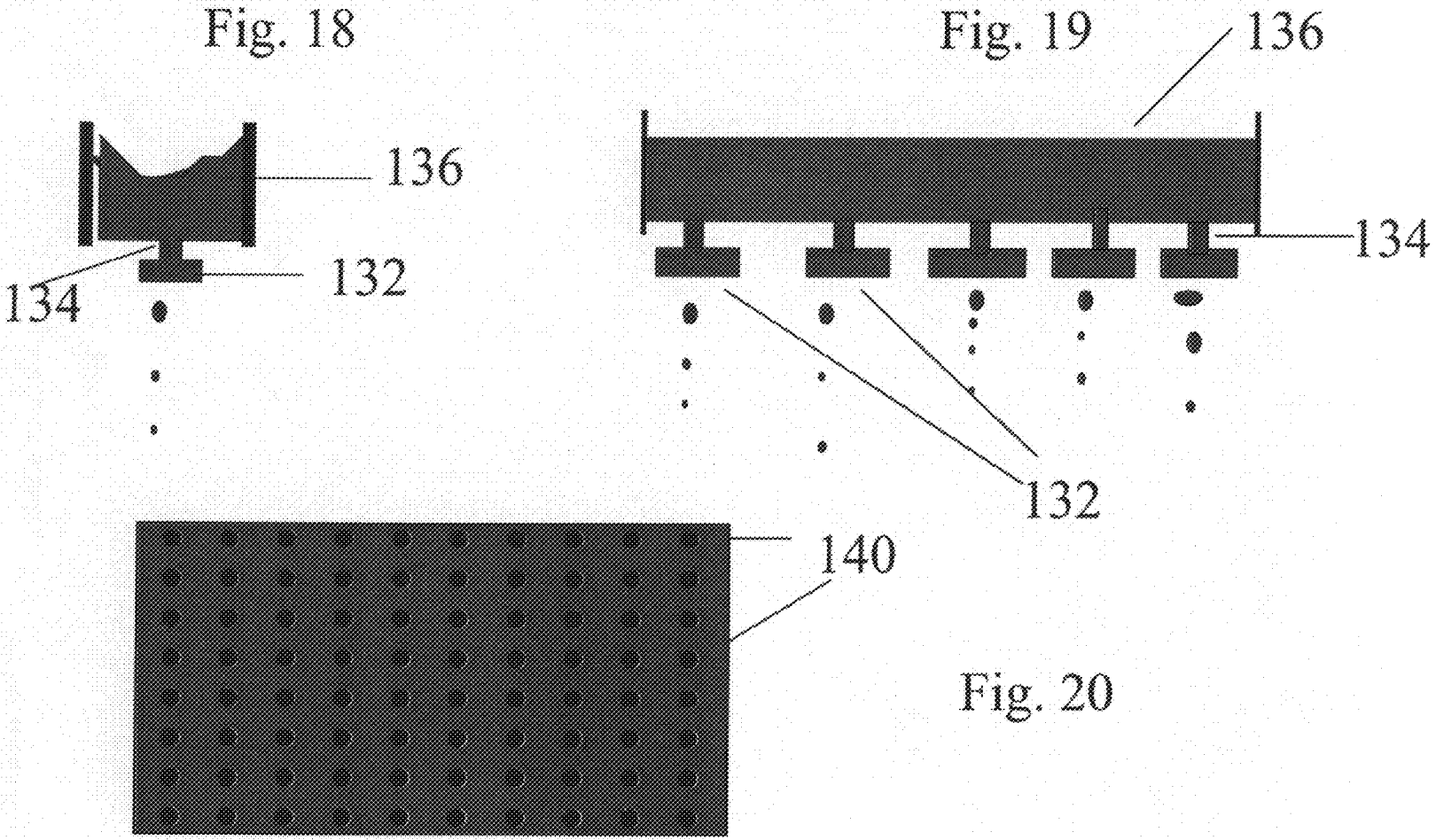
Figure 21A:
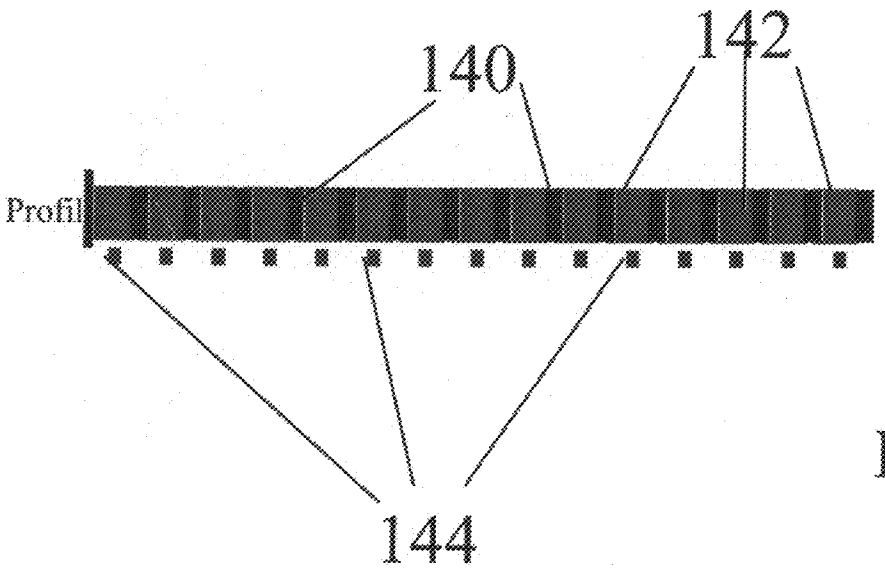
Figure 21B:
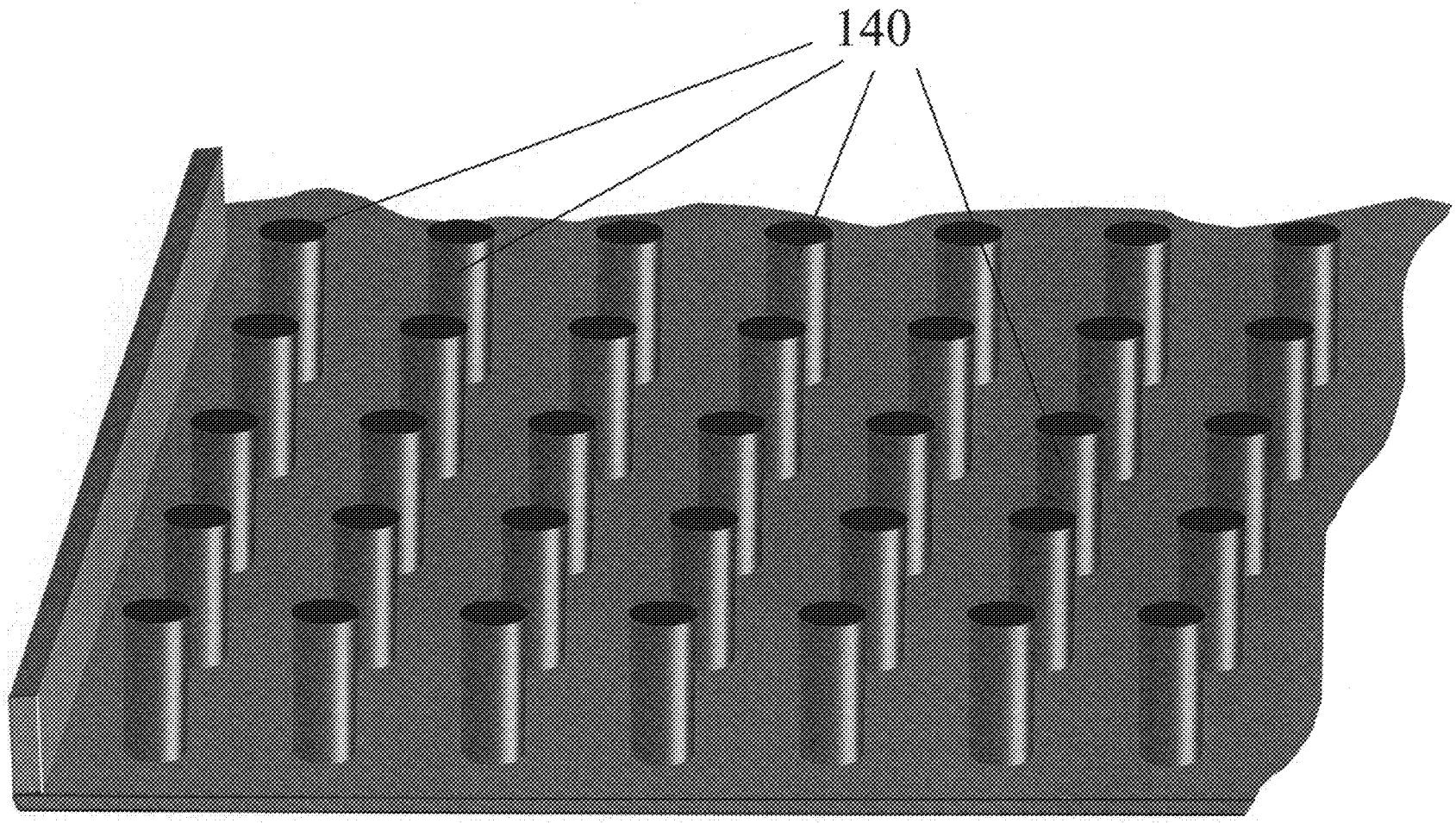
Figure 22:
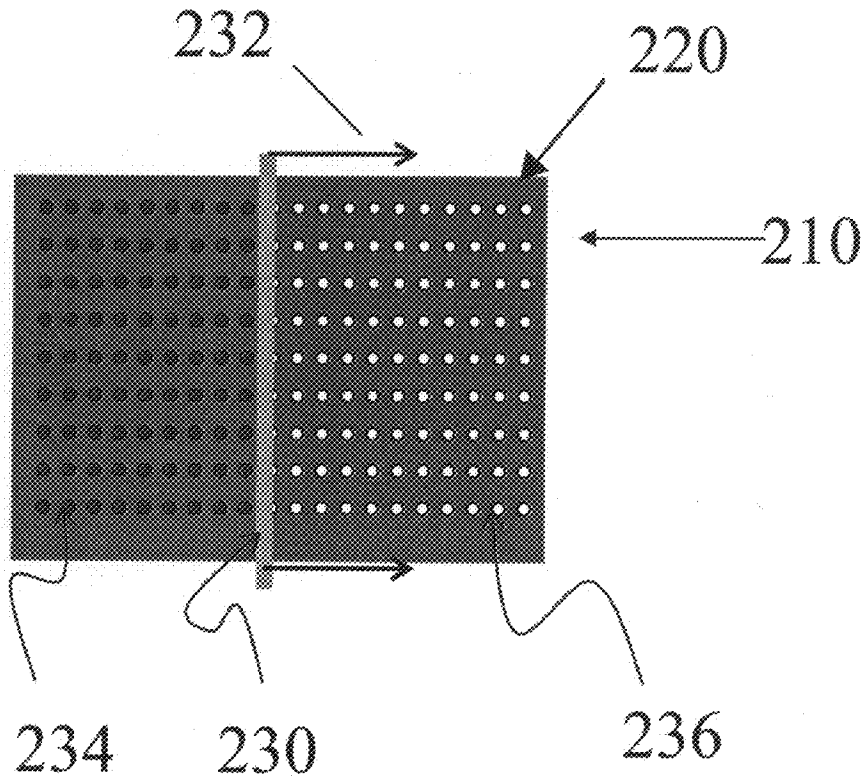
Figure 23:
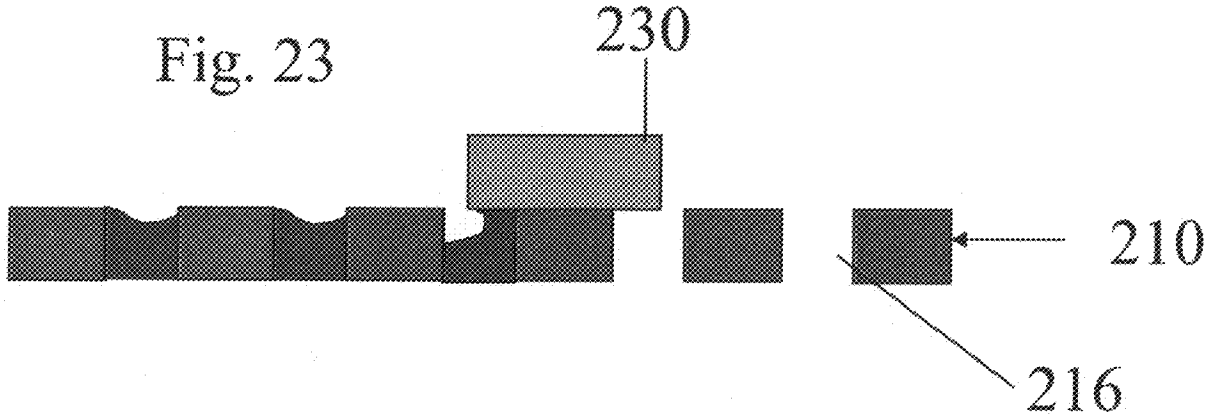
Figure 24:
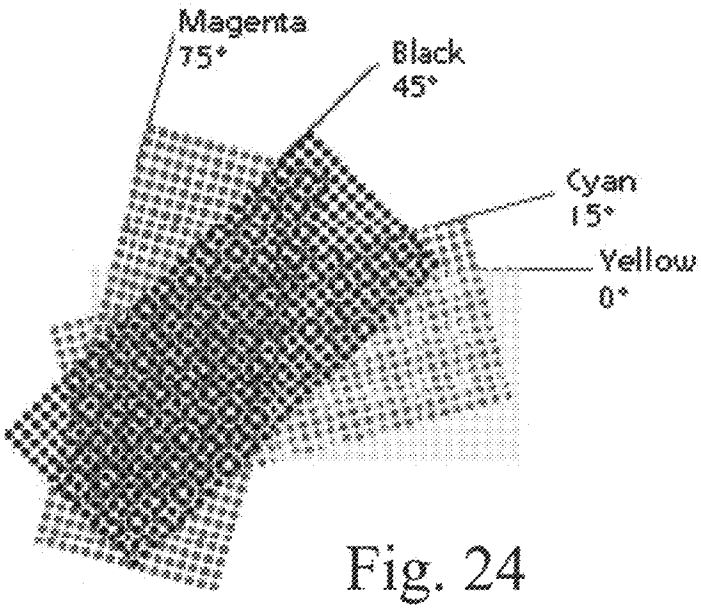
Figure 25:
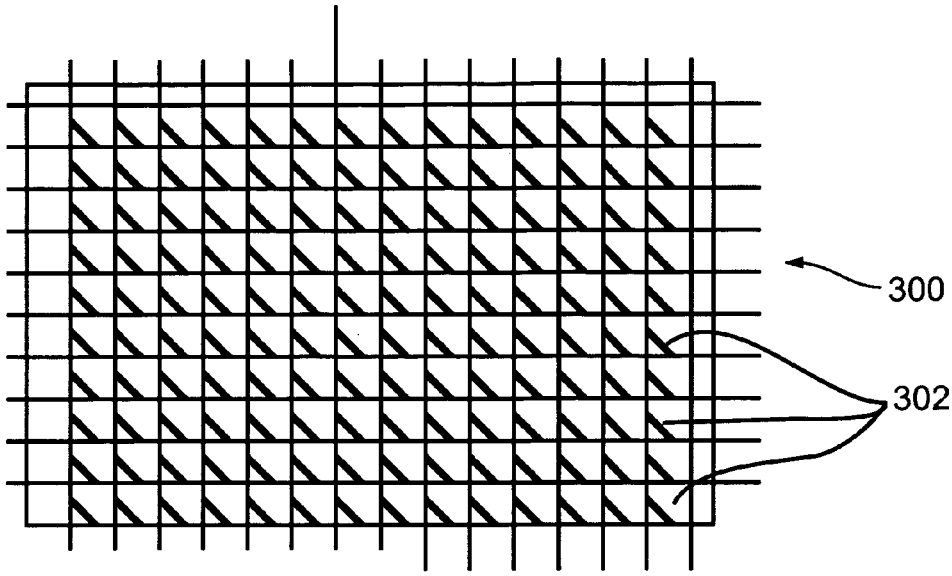
Figure 26:
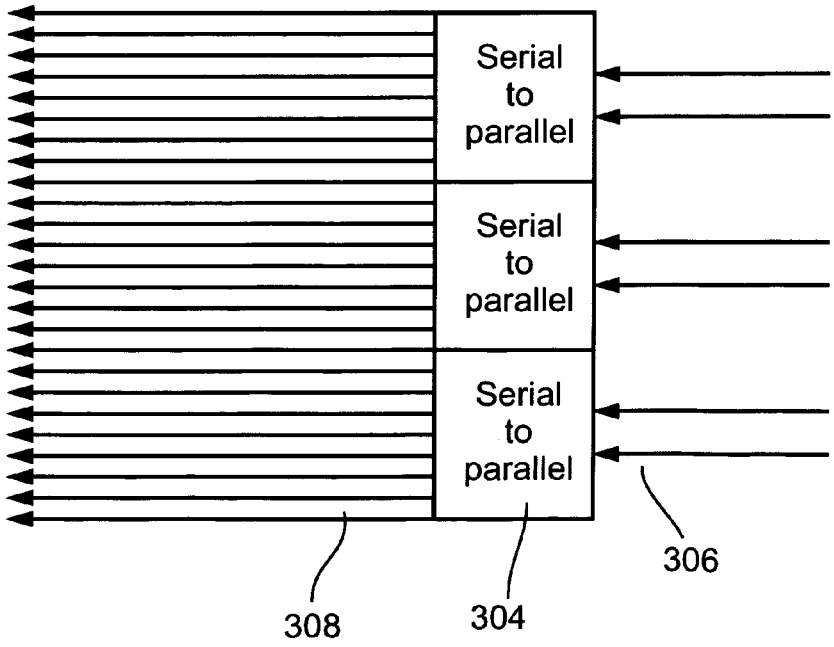
Figure 27:
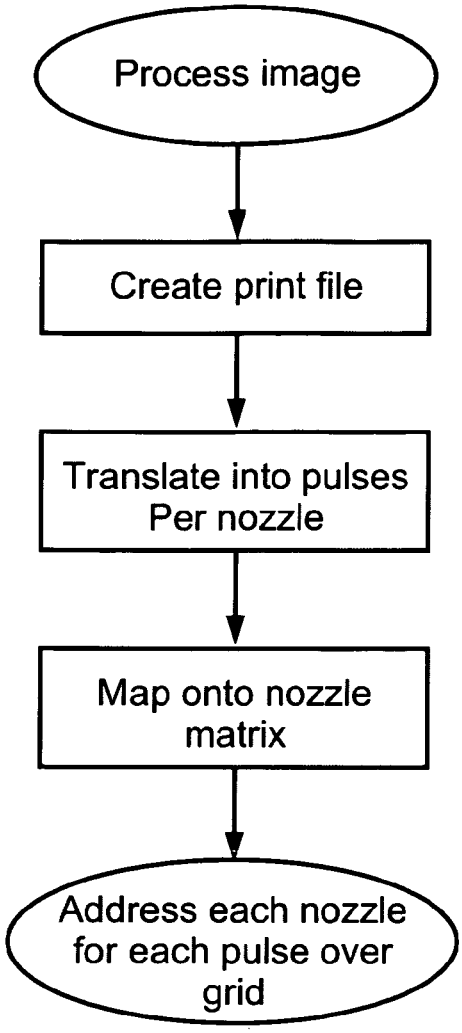
Figure 29:
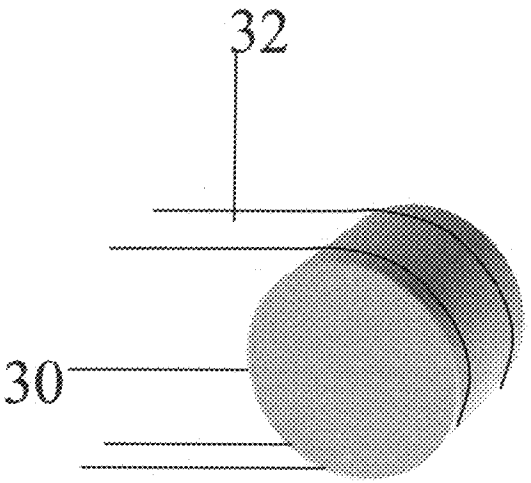
Figure 28:
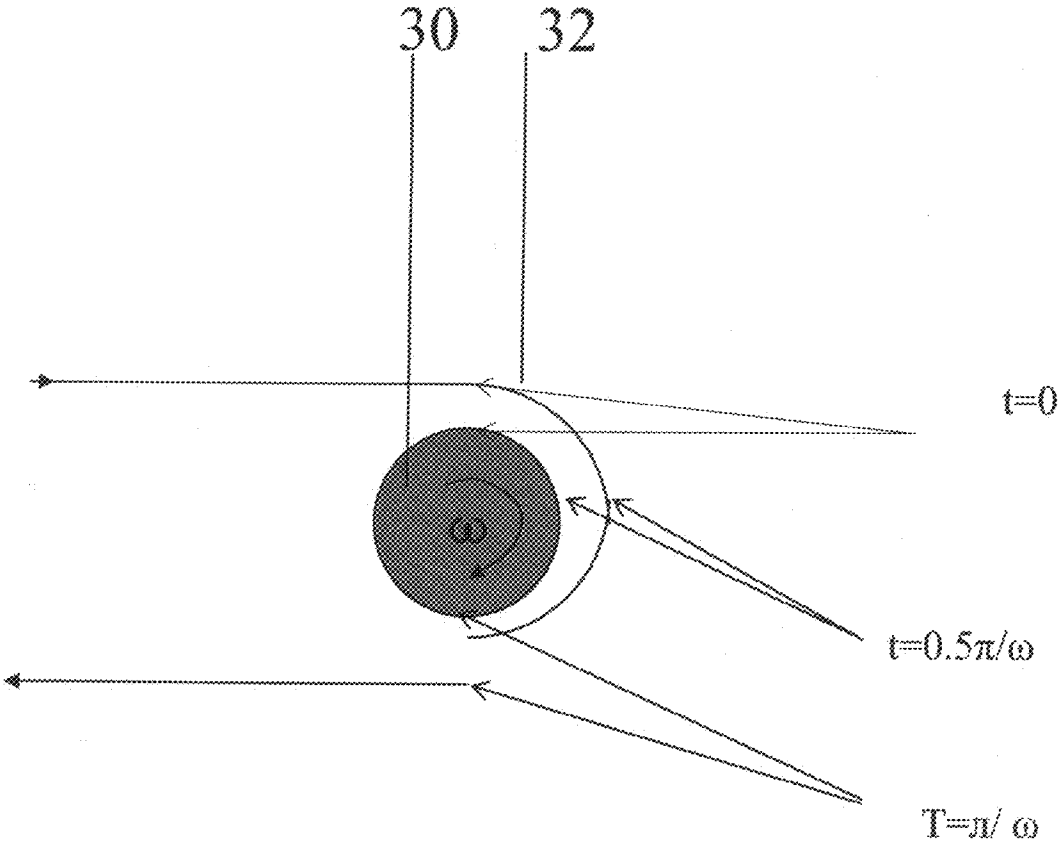
Figure 30:
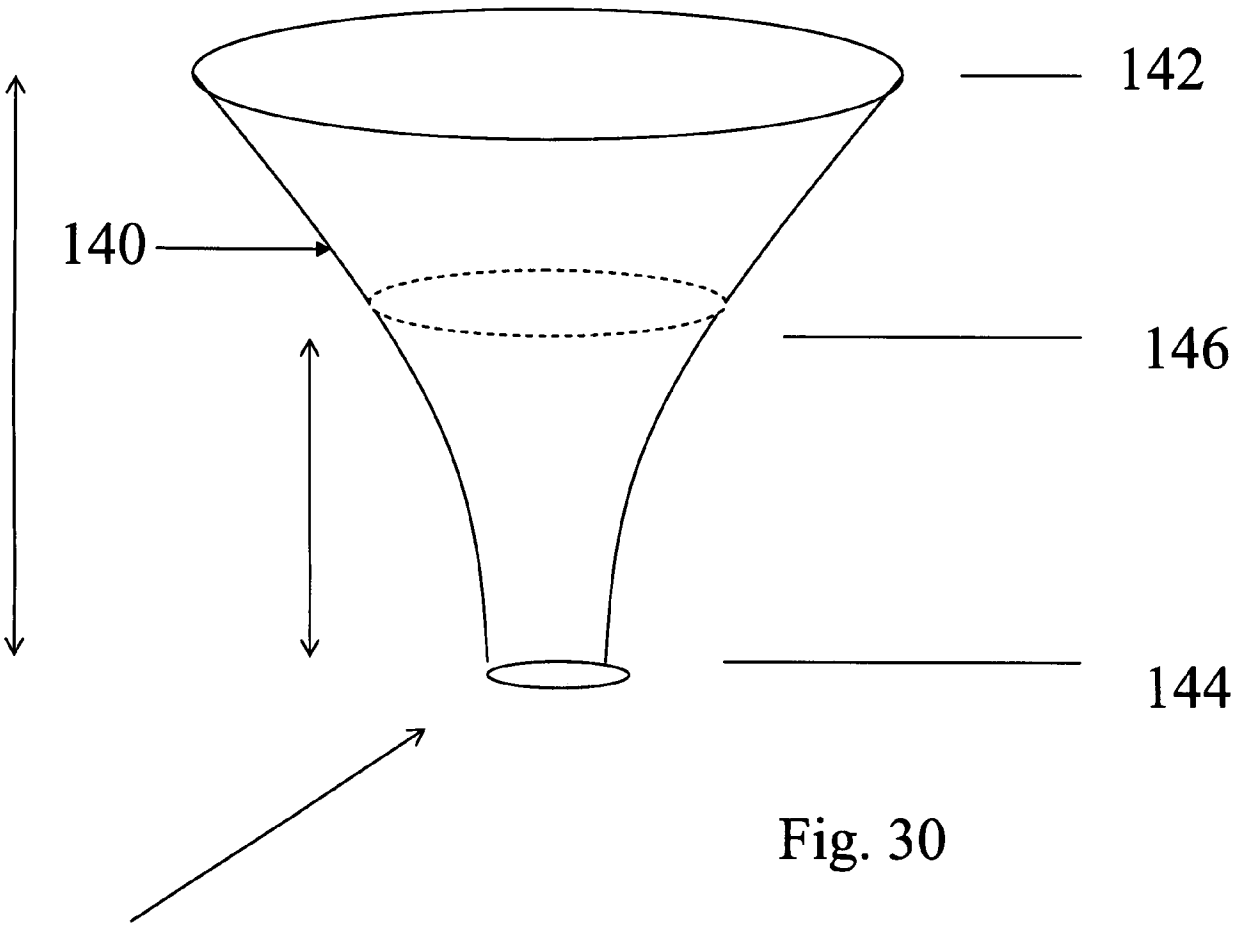
Figure 31:
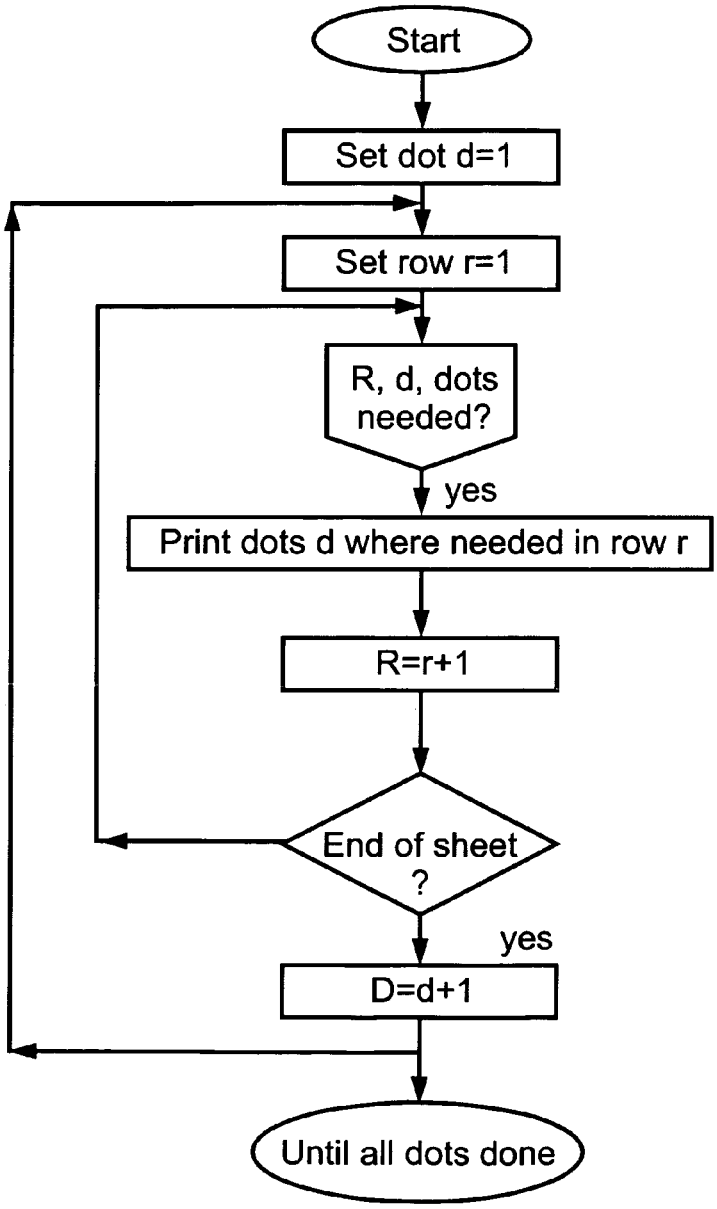
Figure 33:
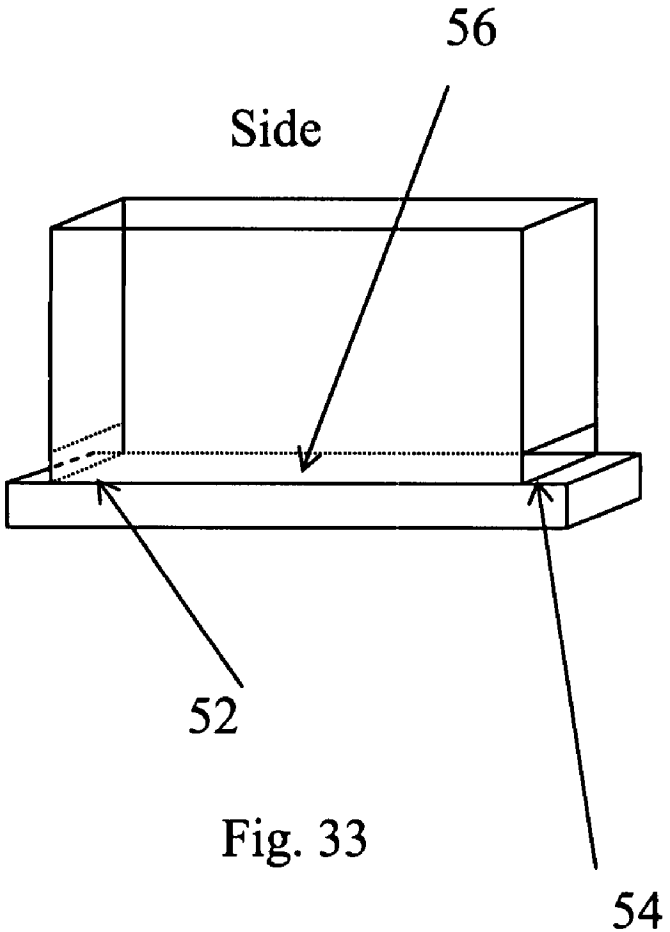
Figure 32:
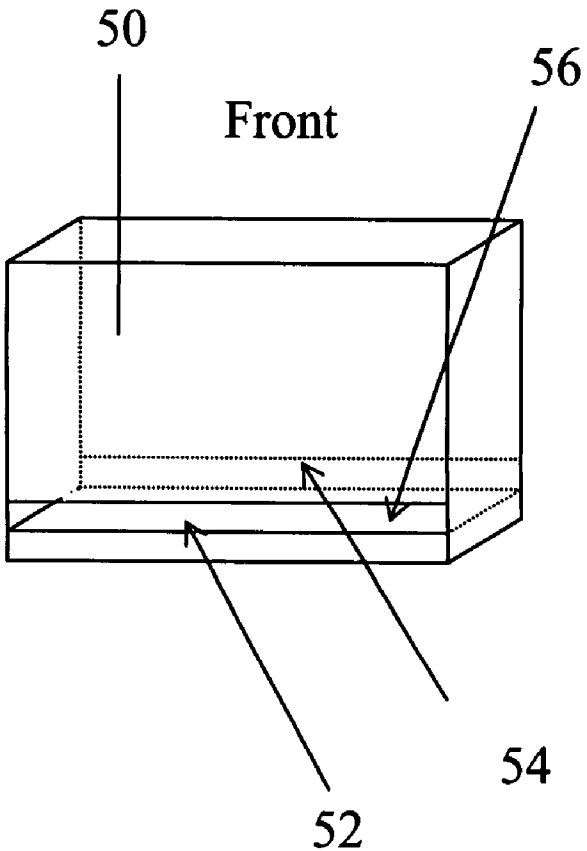

FIGS. 8*a*-8*c* are a three part diagram showing successive stages in bubble formation and ejection from a conventional bubble jet nozzle;

FIG. 9 is a graph showing the change in parameters with time in the vicinity of a nozzle undergoing the process shown in FIG. 8;

FIG. 10 is an electron micrograph of a bubble jet pressure chamber;

FIG. 11 is a schematic diagram of part of a print head having a piezoelectric based ink jet nozzle;

FIG. 12 is a schematic diagram showing operational stages in the nozzle of FIG. 11, and indicating pressures;

FIGS. 13 and 14 are two photographs illustrating the phenomenon of satellite drops in ink jet drop formation;

FIG. 15A is a cross-sectional view of a ink jet nozzle with associated micro-reservoir according to a first preferred embodiment of the present invention;

FIG. 15B is a cross section of a print head matrix showing a series of the nozzle-reservoir pairs;

FIG. 16A is a view from above of an embodiment showing a single micro-reservoir supplying a plurality of nozzles;

FIG. 16B is a view from above of an alternative single micro-reservoir multi-nozzle embodiment;

FIG. 17A is a simplified schematic diagram illustration a channel-type micro-reservoir according to a preferred embodiment of the present invention;

FIG. 17B is a simplified schematic diagram illustrating the ink supply surface of a print head using channel-type micro-reservoirs according to a preferred embodiment of the present invention;

FIG. 17C is a view from the ink supply surface of a printing head using micro-reservoir channels FIG. 18 is a transverse cross-sectional view of a nozzle supplied with ink via a channel-type micro-reservoir, according to the embodiment of FIG. 16;

FIG. 19 is a longitudinal cross-sectional view of a channel-type micro-reservoir feeding a series of nozzles according to the embodiment of FIG. 16;

FIG. 20 is a view from above of the ink supply surface of a print head using a pin-and-free-space type micro-reservoir according to a further preferred embodiment of the present invention;

FIG. 21A is a longitudinal cross-sectional view of the print head of FIG. 20 showing a series of pin-and-free-space type micro-reservoirs feeding a series of nozzles according to the embodiment of FIG. 20;

FIG. 21B is an angular view from above of a pin and free space type micro-reservoir according to the embodiment of FIG. 20;

FIG. 22 is a simplified diagram showing the ink supply surface of a print head according to the present embodiments and illustrating an ink supply mechanism according to one preferred embodiment of the present invention;

FIG. 23 is a simplified cross section showing how the ink supply mechanism of FIG. 22 fills the micro-reservoirs by capillary action;

FIG. 24 is a simplified diagram illustrating the concept of screen angles which can be used to disguise mis-registrations in multiple cycle printing;

FIG. 25 is a simplified schematic diagram illustrating the matrix of print nozzles in the print head as a matrix of on-off switches to be controlled by the printer driver;

FIG. 26 is a simplified diagram illustrating how serial-to-parallel conversion can be used to allow a printer according to the present invention to be connected via standard connectors to a supervising computer, and FIG. 27 is a simplified flow chart illustrating the stages in converting an image file into a printed image using a print head according to the present embodiments;

FIG. 28 is a simplified diagram showing a matrix print head according to the present embodiments in the shape of a cylinder, and with a paper feed mechanism;

FIG. 29 is a perspective view from the side of the cylinder of FIG. 28;

FIG. 30 is a simplified diagram showing a micro reservoir whose outer contour is shaped to compensate between weight of ink and capillary force so that the output pressure at the nozzle is independent of the quantity of ink;

FIG. 31 is a simplified flow chart illustrating a method for obtaining a print speed which is substantially independent of the firing frequency at the nozzles;

FIG. 32 is a schematic view of an enclosed print area for use with a print matrix of the present invention; and FIG. 33 is a schematic side view of the enclosed print area of FIG. 32.

DESCRIPTION OF THE PREFERRED EMBODIMENTS

In the present embodiments, a method and apparatus for ink jet printing are disclosed in which a full image, or a substantial part of it, is printed simultaneously by a 2-D full array of ink jet nozzles. The array comprises a matrix which covers the printing area so that each nozzle relates to a corresponding pixel on the medium. It is therefore possible to print without having any relative motion between the array and the print medium.

More particularly, the embodiments disclose a 2-D full array ink jet printing apparatus, which contrasts with the one-dimensional full array that is well known in the art of inkjet printing. The 2-D full array creates the printed image using a matrix having a large number of ink jet nozzles. The number of nozzles is analogous to the number of pixels in LCD screens. The matrix preferably covers the entire print area, thereby avoiding the need for relative movement between the print head and the print medium. In practice what is formed is an ink jet printing screen.

Within the matrix, the ink jet nozzles are constructed with local ink storage reservoirs that feed nearby ink jet nozzles. The local reservoir is located in the vicinity of one or more ink jet nozzles that it feeds and is preferably open to atmospheric pressure at the reverse, that is non-printing, side of the matrix. Drop ejection is carried out under substantially unregulated pressure conditions. Ink may be supplied to the local reservoirs by a smearing method, that is using a wiper to wash a layer of ink over the reverse side of the matrix. An alternative embodiment sprays ink over the reverse side of the matrix and other tubeless embodiments are contemplated for ink delivery. The ink storage reservoirs then fill with ink due to the capillary properties of the ink.

A preferred embodiment uses a single reservoir per nozzle. Another preferred embodiment uses one reservoir for a number of nozzles, for example a micro-reservoir feeds a group of nozzles in its immediate environment.

The current art does not disclose or suggest such a printing matrix in the ink jet field for a number of reasons. One of the reasons is the need to supply ink reliably to each of the nozzles in the matrix and at the same time to keep the correct pressure conditions in the ink reservoir of each nozzle to allow formation of the drop. Current technology uses tubes from a central reservoir, and such a system is unable to effectively supply ink to so large a matrix in a reliable manner.

More particularly, in the early days of drop on demand ink jet technology the pressure conditions applied to the fluid inside the ink nozzle reservoir were not strictly those of negative pressure as is invariably the case today. Over time, there was a demand for a constant pressure. Both positive and negative pressure points were used, but over time negative pressures came to be preferred as stable working points. For discussion of this issue see U.S. Pat. No. 3,946,398, the contents of which are hereby incorporated by reference. As drop on demand technology evolved a slight negative pressure, typically of the order of about 10-20 mm of hydro pressure, turned out to be the optimum working point. The subject is discussed in US Patent Application Nos. 2001/012039 and 2001/043256, the contents of both of which are hereby incorporated by reference. Indeed, all leading products and manufacturers in the field now use negative pressure-based systems.

The slightly negative pressure is typically achieved by controlling the pressure inside a main ink reservoir. The ink is then supplied to the ink jet nozzles by ink channels and manifolds. The extent to which the pressure can be regulated over the channels limits the number of ink jet nozzles that can be supported and thus militates against the use of a large nozzle matrix for printing.

The principles and operation of an ink jet printing matrix and method according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 15A, which is a simplified cross sectional diagram of the region inclusive of a single nozzle of an ink jet print head according to a first preferred embodiment of the present invention. Although the diagram shows a bubble jet type nozzle it will be clear to the skilled person that the invention applies equally well to piezoelectric ink jet printing and to drop-on-demand type printing in general. The ink jet print head comprises a matrix 110 into which are machined nozzles 112 for controlled formation and release of ink drops for printing. The nozzles include a release mechanism 114 such as a heating element or piezoelectric element, and each nozzle 112 is associated with a local ink storage reservoir 116 from which it is replenished with ink. Preferably, each nozzle 112 is arranged with its own respective local ink storage reservoir 116, although it is also possible to provide a larger storage reservoir that feeds a number of surrounding nozzles. Two limitations are that the storage reservoir should be small enough to be filled effectively by capillary action, and that the reservoir fulfils the dimension requirements of the reservoir dimension equation given hereinbelow.

The matrix 110 preferably has a print surface 118 and an ink supply surface 120. The nozzles 112 are arranged within the print head matrix 110 so that the nozzles have outlets 122 towards the print surface 118. The local ink reservoirs have openings or inlets 124 towards the ink supply surface 120 and additionally are open to the nozzle they are intended to supply.

Reference is now made to FIG. 15B, which is a simplified cross-section of a print matrix showing a series of reservoir-nozzle pairs. Parts that are the same as in FIG. 15B are given the same reference numerals and are not described again. As explained, each nozzle has its own reservoir and the nozzles and reservoirs are provided at a predetermined density over the matrix.

An equation that is preferably used to determine the dimensions of the micro reservoir is as follows for one micro reservoir per one nozzle:

$$[A \cdot H \cdot P \cdot g - L \cdot S \cdot \cos(\theta)]\frac{\pi R^2}{A} < S \cdot 2\pi R$$

where

L=length of contact between the ink and the walls of the micro-reservoir,

θ=contact angle between the ink and the walls of the micro reservoir;

A=the effective area of the cell, that fills with the fluid ink;

H=Height of ink level;

P=specific gravity of the ink;

S=fluid constant of surface tension force;

g=gravity constant; and

R=radius of the nozzle.

In the above equation the ink in the nozzle, which is a low quantity relative to the ink in the reservoir, is neglected.

For example, if the micro chamber is a cylinder with radius—'r' and a height 'h' then:

$$\left[h \cdot P \cdot g - \frac{2 \cdot S \cdot \cos(\theta)}{r}\right]\pi R^2 < S \cdot 2\pi R$$

For the case of D micro-reservoirs per effective unit area A the equation can be modified to:

$$(A \cdot H \cdot P \cdot g - L \cdot D \cdot \cos(\theta) \cdot S) \cdot \frac{(\pi \cdot R^2)}{A} < S \cdot 2 \cdot \pi \cdot R$$

The above equations apply to a micro-reservoir of any of the forms discussed herein, whether a reservoir for multiple nozzles, a reservoir for a single nozzle or a channel for a row of nozzles or a pin. The reservoir for a single nozzle is described with respect to FIGS. 15A and 15B above. Reference is now made to FIGS. 16A and 16B which show two examples of a single reservoir feeding multiple nozzles. FIG. 16A is a view from the print surface of a print head matrix 1000 according to a preferred embodiment of the present invention. Nozzles outlets 1002 pierce the surface 1000. Behind the nozzles, the outlines are shown in dotted lines of underlying reservoirs 1004, 1006 and 1008. Each of the reservoirs has an opening to each of the nozzles 1002 within its coverage, which are thereby fed with ink. FIG. 16B is a similar view of the print surface, and parts that are the same as in FIG. 16A are given the same reference numerals. In FIG. 16B, underlying reservoirs 1010, 1012, and 1014 are round, but still feed the nozzles within their area of coverage in the same way.

In FIGS. 16A and 16B, the reservoirs are of rectangular and circular cross section respectively or in any other shape like hexagon. Likewise in FIG. 15, the single nozzle reservoir may be of square or circular cross section. It is also possible to provide a very thin channel, that is one in which two opposite walls are very close, very close being in terms of the dimensions dictated by the above-quoted equation. In such a case the capillarity force is strengthened. In the limit a thin channel of infinite length has capillarity which pertains only from the walls.

Although the above describes a theoretical case, it is possible to obtain much of the benefit of the theoretical case by machining a narrow channel over the length of a row of nozzles, and reference is now made to FIG. 17A, which is a simplified diagram illustrating a micro-reservoir in the form of a channel machined into the ink-supply surface of the matrix. The channel is open to the outside air at the ink supply surface and preferably supplies all of the nozzles in a row. Thus each row of nozzles has its own open channel as a reservoir.

The above-cited equation applies to the dimensions of the micro-channel reservoir as follows:

$$(Wi \cdot Le \cdot Hi \cdot P \cdot g - 2(Wi + Le) \cdot \cos(\theta) \cdot S) \cdot \frac{(\pi \cdot R^2)}{A} < S \cdot 2 \cdot \pi \cdot R$$

where, with reference to FIG. 17A,

Le=length 124.

Wi=width 126.

Hi=Height 128.

The remaining variables are as defined above.

Reference is now made to FIG. 17B, which is a simplified diagram showing a view, from the ink supply surface, of a printing head using micro-channel reservoirs. A series of parallel micro-reservoir channels 130 are etched into the ink supply side of the matrix. Each of the channels corresponds to a row of nozzles on the printing side of the head and each nozzle in the row opens to the corresponding channel.

Reference is now made to FIG. 17C which is a simplified diagram showing additional detail of the view of FIG. 17B in one preferred embodiment. In FIG. 17C, a side channel 1050 connects to each of the parallel micro-reservoir channels 130. The side channel is supplied with ink in the ordinary way, and capillary sideward force draws ink from the side channel into each of the micro-reservoir channels 130.

Color printing may be provided in the embodiment of FIG. 17C by providing separate side channels for each color and connecting each side channel to only certain of the micro-reservoir channels. Thus for four-color printing, four side channels are provided and connected in turn to micro-reservoir channels over the width of the print head.

Reference is now made to FIG. 18, which is a simplified transverse cross-sectional schematic view of an ink jet nozzle supplied by such a channel. Ink jet nozzle 132 is connected by a neck 134 to channel 136. The nozzle is supplied with ink from the channel via the neck 134.

Reference is now made to FIG. 19, which is a simplified cross sectional diagram taken lengthwise along the channel. Parts that are the same as in FIG. 18 are given the same reference numerals and are not described again except to the extent necessary for an understanding of the present figure. A single channel 136 feeds all of the nozzles 132 in a row.

Reference is now made to FIG. 20, which is a simplified diagram illustrating the ink supply surface of a print head according to another preferred embodiment of the micro-reservoir. In the embodiment of FIG. 20, the micro-reservoirs are formed from a series of pins 140 associated with corresponding free micro-space. The pins 140 are arranged as an array over the matrix, each pin and the corresponding micro-scale free space being associated with a single nozzle. The pins and the space together act as an absorbing layer. Due to capillary force between the fluid and the pins, the free space fills with fluid. Thus the absorbing layer serves as a micro-reservoir for the nozzles.

Reference is now made to FIG. 21, which is a cross-sectional view of the print head of FIG. 20. Parts that are the same as in previous figures are given the same reference numerals and are not described again except to the extent necessary for an understanding of the present figure. Pins 140 and micro-spaces 142 lead to individual nozzles 144. The pins cross-section can be circular or in other shapes. The shape determines the length of contact between the ink and the walls. Therefore, for higher capillarity force a shape with large length of contact is preferred.

Reference is now made to FIG. 21B, which is a perspective view from above of a pin and micro-space type ink supply arrangement. The figure shows more clearly how pins 140 and the spaces in between provide paths for capillary action to fill the reservoirs below.

Reference is now made to FIG. 22, which is a simplified schematic representation showing a view, from the ink supply surface 220, of a part of the matrix 210 and illustrating a preferred embodiment of the ink supply mechanism. The matrix 210 comprises an array of openings into the ink supply reservoirs. The openings are arranged over the entire surface at a density corresponding to the density of nozzles at the opposite surface. The density of nozzles is selected for effective printing at the resolution level that the print head is intended to provide. Preferably the ink supply reservoirs and the nozzles are arranged into a substantially rectangular printing area. The printing area is dimensioned to give simultaneous printing coverage for standard sized printing media. That is to say the printing head is designed specifically for a certain size of printing media, say A4 or A3, and the printing area is designed to cover the entire A4 or A3 sheet. Ink drops are expelled simultaneously over the entire sheet which is thus printed substantially instantaneously. Consequently printing is quicker as the print head does not need to scan the sheet, and neither the print head nor the sheet need to move during the printing, mailing the printing more accurate and making the printer simpler and cheaper. Satellite drops all land at the same point as the main drop since there is no movement in the meantime. Mixing of inks is uniform. The printer is cheaper because there is no need for a mechanism to move the print head or the sheet during printing. As will be appreciated, moving either the print head or the sheet during printing requires accurate alignment ability so that the printing is accurate. The ability to dispense with such alignment ability provides a simplified and cheaper device.

The print head is thus a 2-D full array of numerous ink jet nozzles the array being dimensioned to cover all or a substantial area of the printing area of the print media. It is thus possible to print an area the size of the matrix whilst there is no relative movement between the print medium and the print matrix.

In order to supply ink to an array of nozzles of the size being discussed, the conventional ink distribution system based on pipes and a central reservoir is dispensed with. In its place a tubeless ink distribution device is associated with the ink supply surface for distributing ink over the surface so that the ink reaches the openings of the local ink reservoirs and enters the reservoirs by capillary action.

In a first preferred embodiment, the ink distribution device is a wiper 230, which is coated with ink and which is then wiped over the ink supply surface 220. As a result ink is distributed in sufficiently large quantities to be taken up into the ink supply reservoirs.

Preferably, the wiper 230 is made of material selected for good capillary and fluid absorption properties. The wiper scans the ink supply surface to pass each micro reservoir 216. Due to capillary action, the micro reservoirs are refilled with ink as shown hereinbelow with respect to FIG. 23.

In a preferred embodiment, the wiper 230 is connected to a main ink reservoir by a channel. The ink pressure at the main reservoir is sufficient to keep the wiper 230 filled with ink but not strong enough to cause dribbling of the ink. When there is physical contact between the wiper 230 and the micro reservoir surface, ink is pulled from the wiper 230 to the ink supply surface. That is to say the wiper wets the surface. When the surface is wetted, capillary action fills the micro reservoirs.

In an alternative embodiment, the ink distribution device is a spray device, which sprays ink over the ink supply surface, again in sufficient quantities to be taken up by the ink supply reservoirs.

In either of the above embodiments, the ink distribution device provides ink to the reservoirs at atmospheric pressure. In the single nozzle single reservoir embodiment there is no fluid connection between the different nozzles so that shock waves do not travel across, and in the channel reservoir embodiment there is a fluid connection but only between nozzles in the same row. Thus, generally, phenomena of cross-talk are eliminated. Other causes of changes in drop velocity at given nozzles are also eliminated by such an ink supply system.

As shown in FIG. 22, the wiper 230 travels in the direction of arrow 232. Reservoirs 234 already passed by the wiper are full of ink, and reservoirs 236 beyond the wiper are unfilled.

Reference is now made to FIG. 23, which is a cross section of matrix 210 showing a series of reservoirs and the wiper at an intermediate stage therebetween spreading ink. Parts that are the same as in previous figures are given the same reference numerals and are not described again except to the extent necessary for an understanding of the present figure. FIG. 23 illustrates ink immediately behind the wiper filling the reservoir by capillary action.

Considering the ink reservoir in greater detail, first of all it is noted that, contrary to conventional methods of ink supply, the preferred embodiments supply ink to the numerous ink jet nozzles in parallel and in a manner that is open to the ambient pressure. As explained, each ink jet nozzle has a refill opening that communicates with a local micro-reservoir such as reservoir 116 in FIG. 15. Several alternative designs of the micro-reservoir are now described.

A large number of micro-reservoirs are constructed within the matrix. In a preferred embodiment the micro-reservoirs are constructed at the rate of one per nozzle. The reservoirs in this embodiment serve as individual micro-reservoirs for the individual nozzles. The reservoir is local and has no communication with adjacent reservoirs. Even when the reservoirs are shared between nozzles such as in the micro-channel embodiment, the nozzles all work at atmospheric pressure and thus the pressure effects on the ink supply that vary the velocity between the nozzles do not apply. Even if such effects were to apply, the fact that there is no relative motion between the nozzles and the media implies that the drop velocity has little influence on where the drop lands.

It is further noted that whereas in a conventional print head, each nozzle fires at the order of tens of thousands of times per image printed, in the present embodiments, the number of firings per image of each individual nozzle is four orders of magnitude less, thus considerably enhancing the lifetimes of the nozzles.

As will be appreciated, the full array matrix of the present embodiments comprises a larger number of nozzles than in a conventional ink-jet print head. A matrix address method is preferably used in order to switch individual ink jet nozzles on and off. Addressing is similar to matrix addressing systems used for a 2-D graphic screen display or, for that matter for a memory chip. The matrix has a driver which is responsible for addressing the various ink jet nozzles. Upon being addressed, a pulse is sent to ink expulsion device 114, which in its turn releases or ejects the drop.

Using the present embodiments it is possible to create full and half tone dots. Thus, in order to create half tone dots the driver can send a certain series of pulses to the given ink jet nozzle, as a result of which a corresponding series of drops are ejected and a desired amount of ink lands on the print medium to define a half tone dot. For a full tone dot a larger series of pulses is used. It is also possible to program quarter and other levels of tone as desired. As will be appreciated, the use of multiple dots per pixel was not possible, or at least was extremely limited, in the prior art due to the relative movement between the head and the print media during printing.

As described hereinabove, drop ejection preferably takes place when the print matrix and the print medium are relatively static. Thus, if one of the ink jet nozzles ejects two drops one after the other they generally land at the same point on the print medium. The property may be taken advantage of to vary the amount of ink delivered to a spot by using a basic drop size and then selecting a number of drops for launching at the same spot. The number of drops specifies the extent to which the drop spreads out. That is to say it is possible to transfer different amount of ink to the different pixels on the print medium, so that the different amounts of ink produce spots with different sizes. Use of the phenomenon supports the technique known as half-tone multiply gray scale, and reference is made in this connection to European Patent No 1,213,149, the contents of which are hereby incorporated by reference. The variable size of drop thus supports AM printing, a technique not currently possible with ink jet printers.

In a preferred embodiment a multiple cycle printing is performed. The full image is printed in several print cycles. Between each cycle there is a minute displacement between the print medium and the print matrix, minute meaning smaller than the matrix density, or the distance between two neighboring nozzles. It is noted that the pixel, as far as the printed page is concerned, is the drop size, and the resolution depends on the drop size and the distance between two neighboring drops. Conventionally the distance between two neighboring drops is set by the distance between two neighboring pixels. However a minute displacement may now be performed. After the displacement is completed, the print medium and the print matrix are held static and another print cycle is performed, so that now the resolution is set by the drop size and by the distance between the same nozzle before and after displacement. The use of multiple print cycles in this manner with minute displacements increases the overall resolution of the image beyond the density of the nozzles in the printhead.

The minute displacements may be controlled via communication with the overall controlling print process from the printer driver in the associated computer. Alternatively there may be a fixed pattern of displacement, for example spiral. As a further alternative a random displacement within fixed bounds can be applied.

The displacement is preferably effected by the use of two or more linear actuators, which may be piezoelectric actuators for example, attached either to the print head mounting or associated with the paper feed. The actuators provide minute displacement in two axes (x-y). It is noted that the actuators are for micro movements at a scale below that of the spacing between the nozzles. Thus, the mountings of the print head or the paper feed are still considered as stationary. The result is FM printing since the system controls the pixel density.

The present embodiments support color printing as follows. Printing a color picture requires printing with several basic colors, for example cyan, magenta, yellow, black and possibly more. In standard ink jet printers the colors are printed altogether while the print head performs a print scan. In the present embodiments where there is no scanning, each color uses a corresponding print head and the different colors are printed one after the other. The technique is that used in offset print technology where the print heads take the place of the different color plates.

Reference is now made to FIG. 24 which is a simplified diagram illustrating the concept of screen angles, that is use of an angular offset between the plates, as commonly used when printing in cycles, as for offset based color printing. The reason for using an angular offset is that it disguises any linear offset that may result from a registration inaccuracy between the different color cycles.

Figure 1:
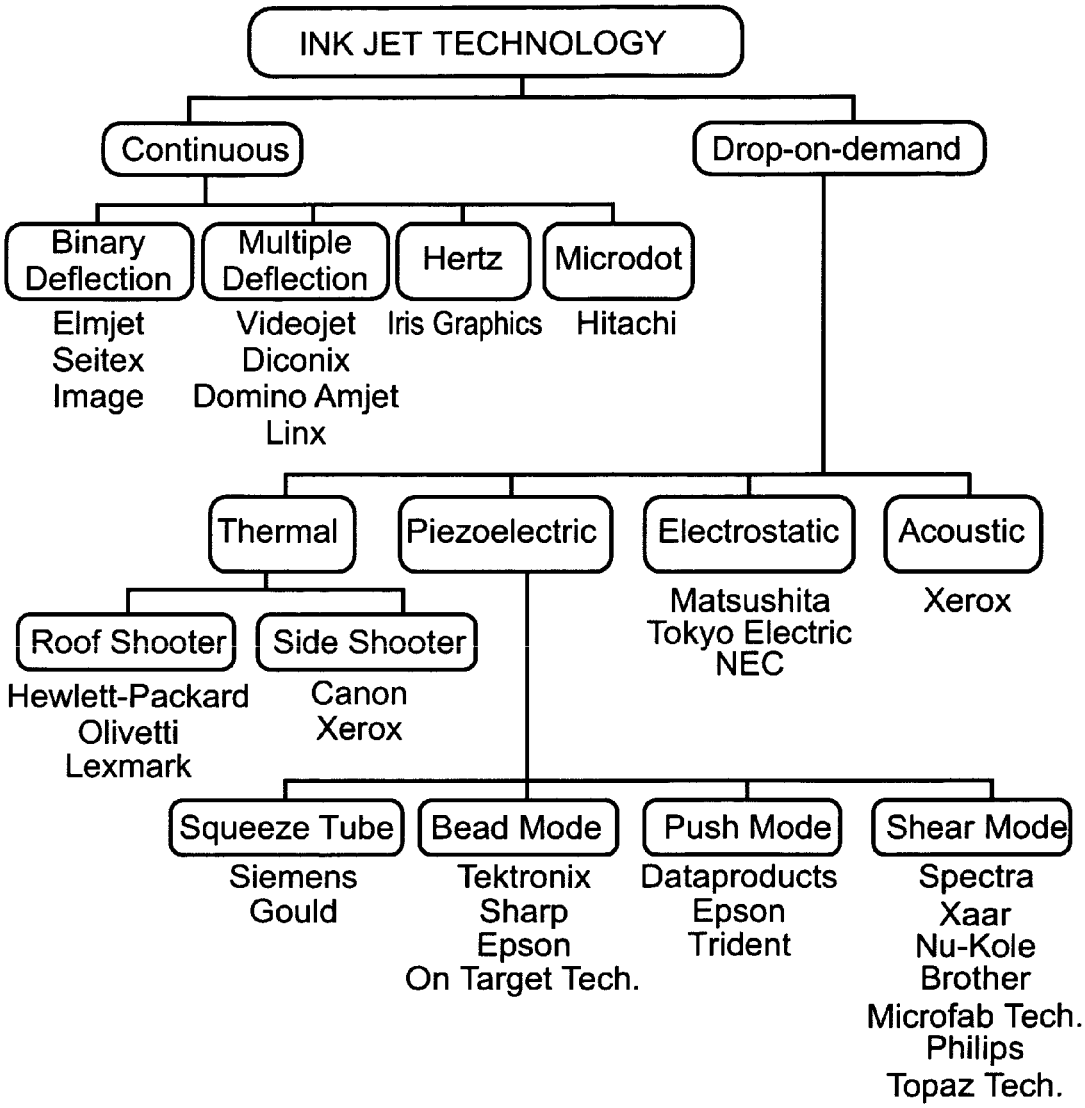
Figure 2:
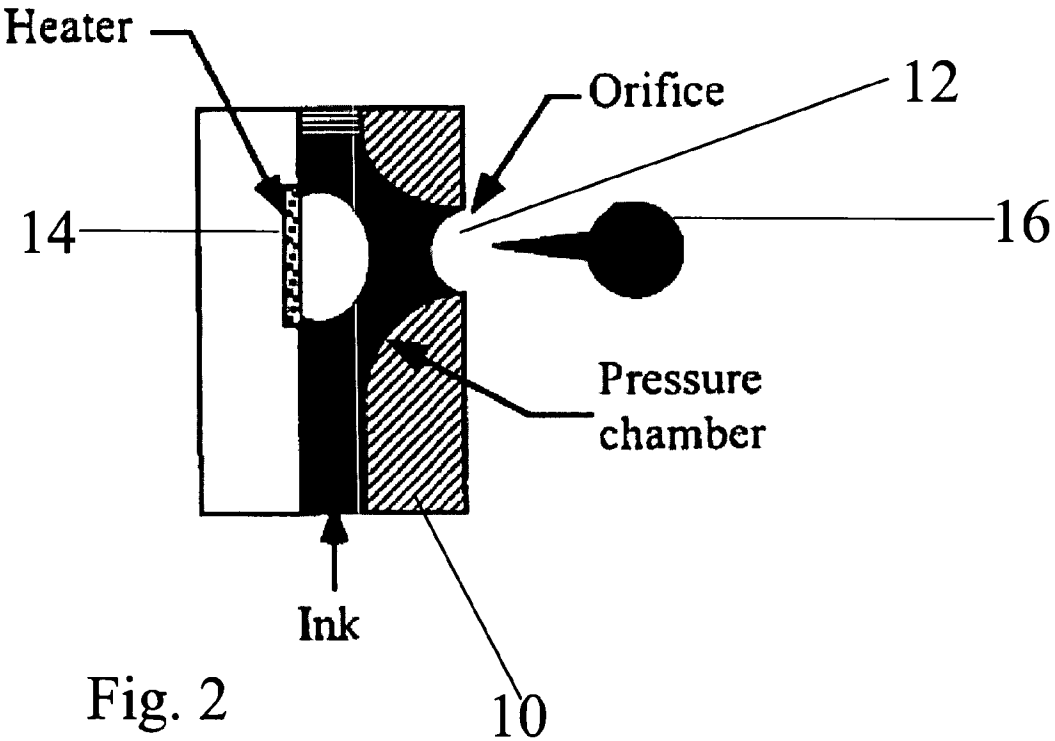
Figure 3:
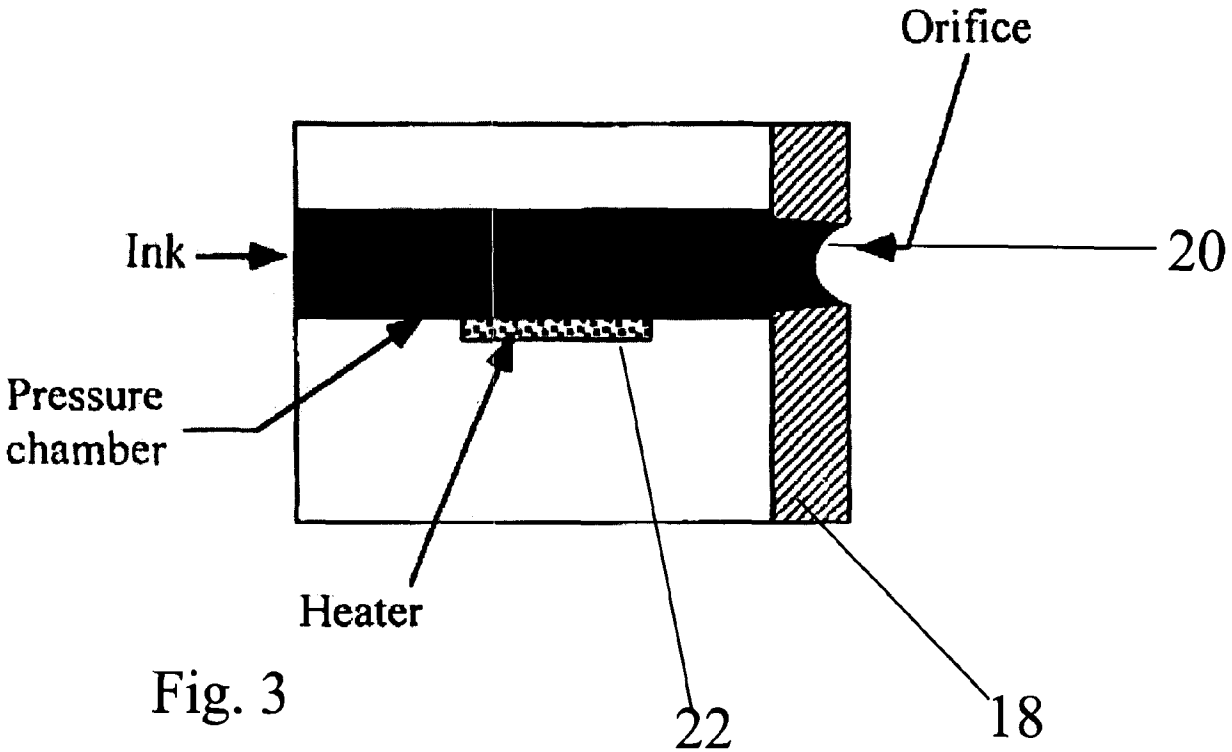
Figure 4:
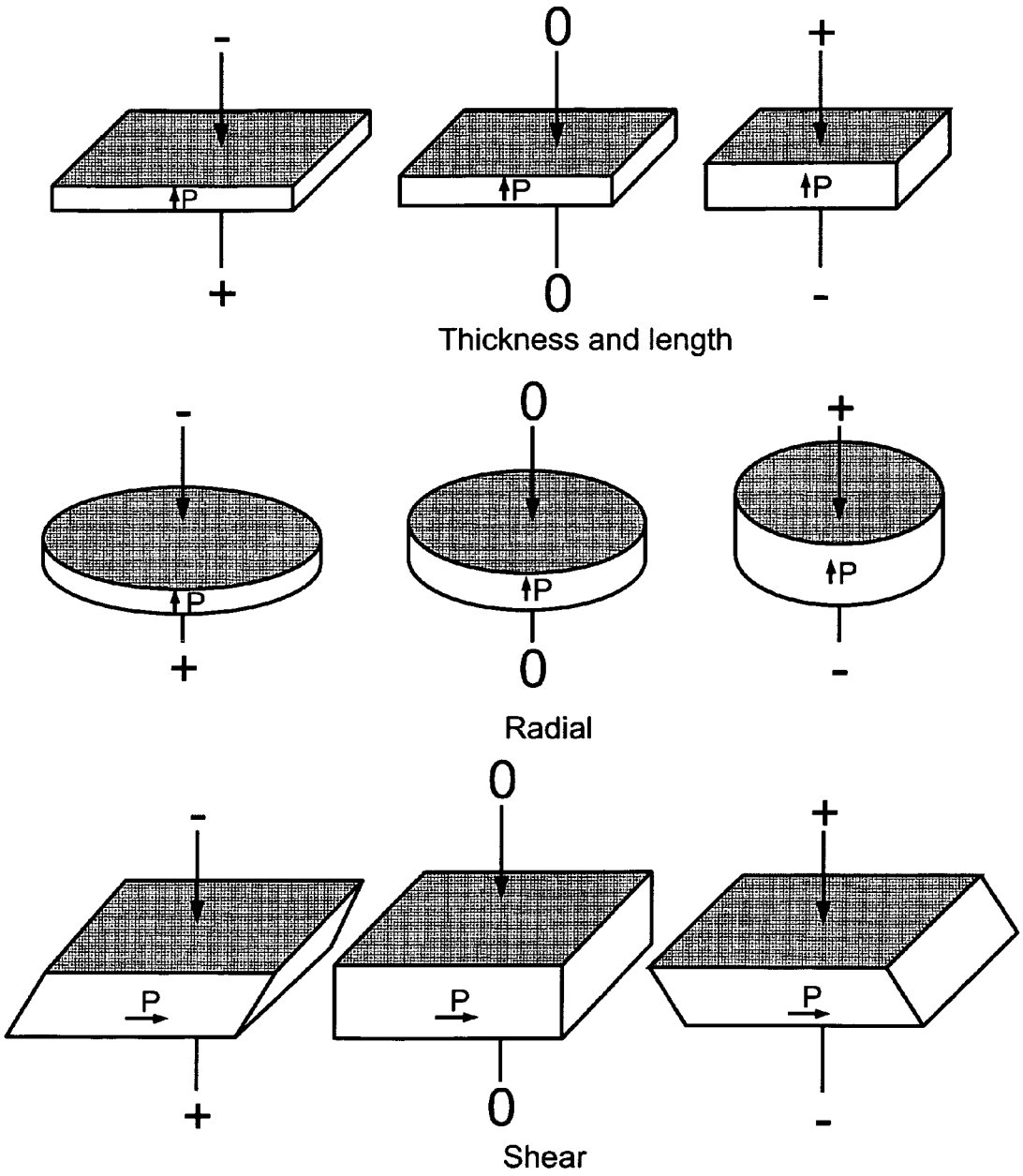
Figure 5:
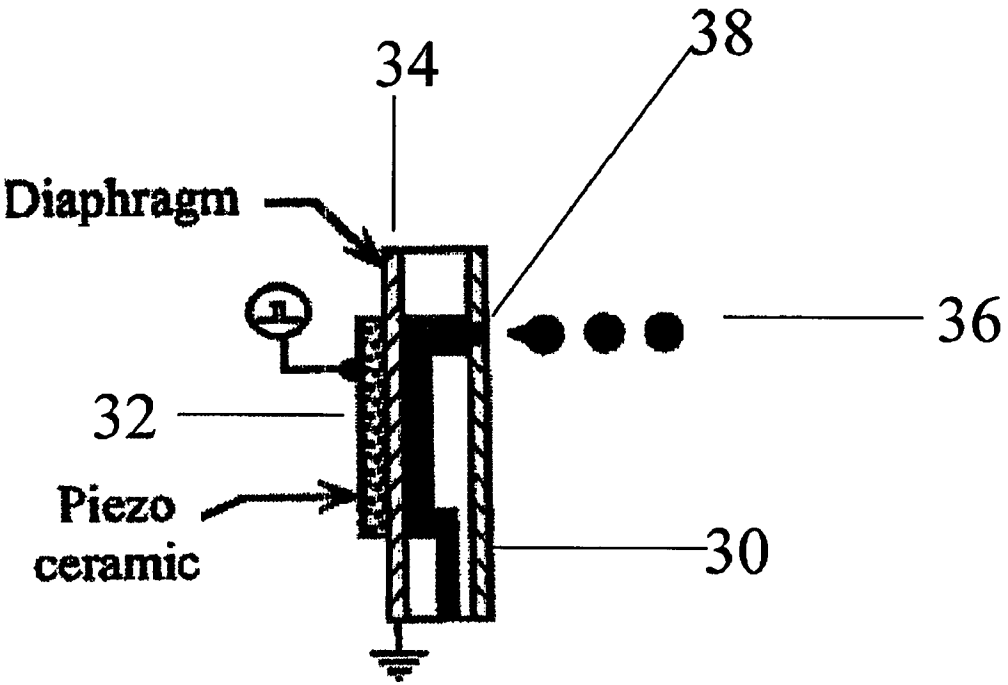
Figure 6:
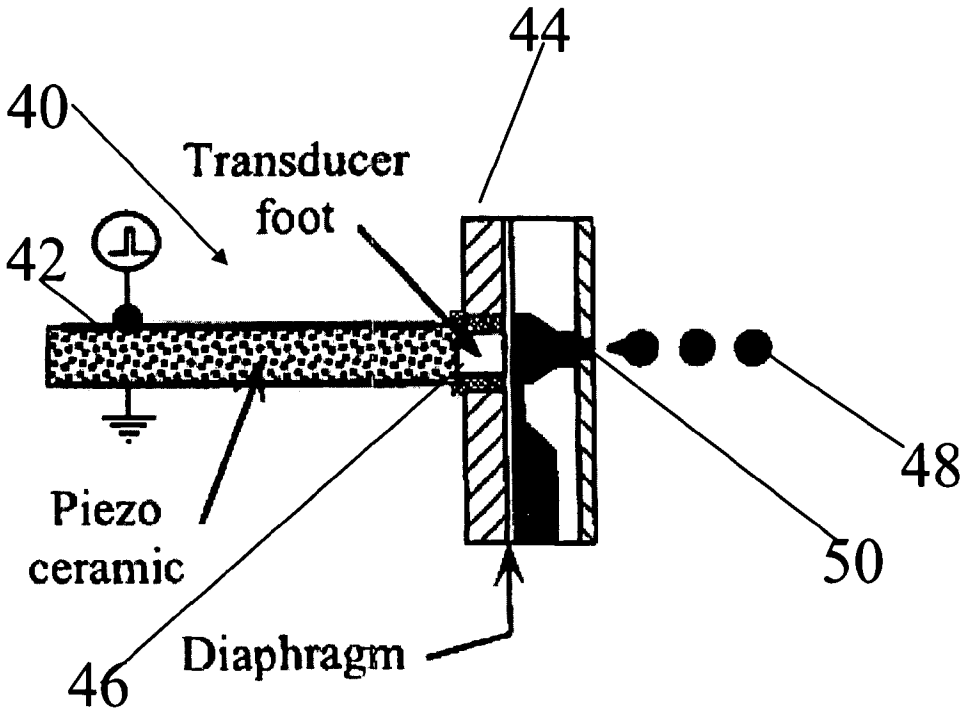
Figure 7:
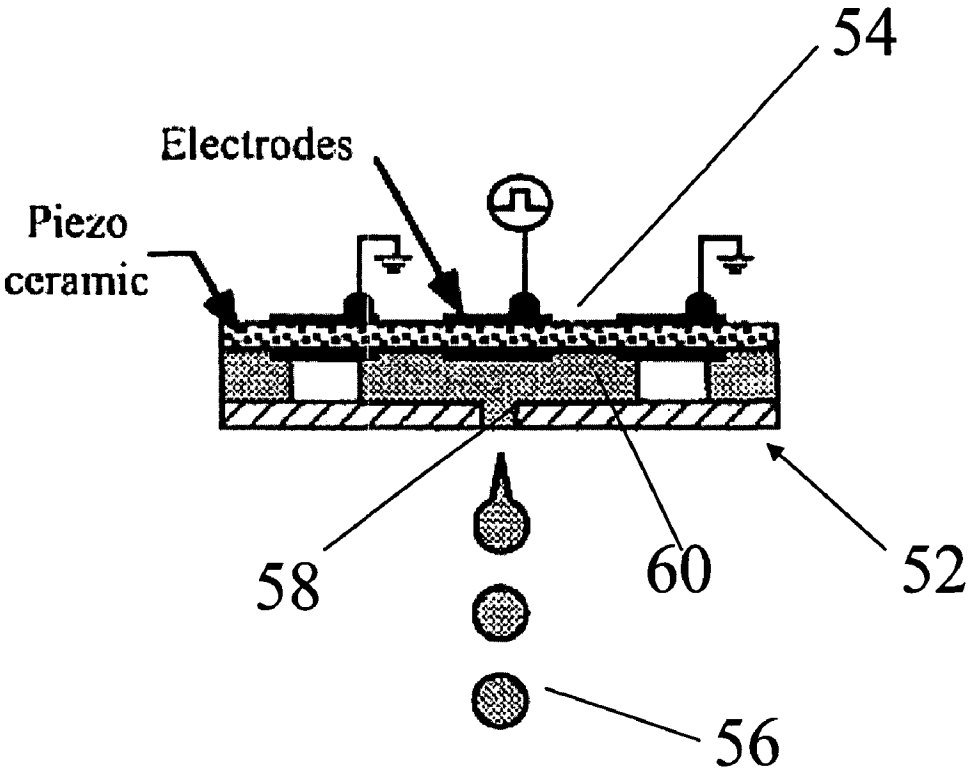

More particularly, in offset and mesh printing technologies the base colors are printed one after the other with different plates. A well-known problem is the registration of these different colors, that is relative print location accuracy between the colors. The problem is solved by a standard technique known as "screen angle"—creating angles between the colors. The technique has no meaning in standard ink jet printers, which print all the colors in a single scan. As described hereinabove, the present embodiments print the different colors one after the other. Such a cyclic method of printing introduces a need to print with screen angles. The matrix axes of the different colors are given different angles as can be seen in FIG. 6. In the figure, the angle applied to yellow is 0 degrees, cyan 15, black 45, magenta 75. Different orders may also be implemented.

Reference is now made to FIG. 25, which is a simplified diagram illustrating the printing head as it appears electronically to the computer controlling the printing. The printing head 300 appears as a matrix of on-off switches 302 to be set in accordance with the requirements of the image. The switches correspond to the ink expulsion devices 114 and setting a switch corresponds to expelling ink from the given nozzle. As discussed above, tone variations can be provided by setting a minimum size ink drop which is a fraction of the ink required to supply a pixel with the necessary ink for full tone. Thus a series of pulses can be used to set any multiple of the minimum size ink drop. As mentioned above, such a feature enables AM type printing.

FIG. 26 is a simplified diagram illustrating a serial to parallel converter for converting serial data output from the output connections 306 of a controlling computer. The data is converted to parallel form for addressing the matrix within the printing head through parallel data bus 308. The serial to parallel conversion allows connection of the matrix links to parallel to serial "multiplexes" at the printer itself in order to reduce the number of pins in the printer connector.

The stages of the printing process are shown in the flow chart of FIG. 27.

A first stage involves processing the digital image file to extract the information needed for printing, so that the information can then be fed to the driver.

The information that has to be extracted is the number of drops each nozzle of the print matrix has to fire. Typically the number of drops defines the halftone spot on the print medium. The information may be represented in a 2-D matrix of numbers where the number of rows and columns are the same as the ink jet nozzles in the print matrix and the number that is stored in each index of the matrix of numbers represents the number of drops that has to be fired by the corresponding ink jet nozzle in the print matrix.

The information is extracted from the original image file, typically a file which contains 2-D matrix data for each color. The information is generally in the form of a number between zero and 255, and represents the gray level for that color of the corresponding pixel. For each gray level in the original file there is a corresponding gray level on the print medium—a halftone dot that is made by a corresponding number of drops. The following assumes that there is a one-to-one or linear correspondence between the image file gray level and the print file gray level, but the skilled person will be aware that this is not necessarily the case.

So for each index in the original image file there is a corresponding ink jet nozzle in the print medium and for each gray level in the original image file there is a corresponding number of ink drops.

Thus, for example:

The correspondence of gray level is by the equation:

$$N(\text{number of drops})=G(\text{original gray level})/255$$

TABLE 1

| Original image file | | | | |
|---|---|---|---|---|
| 255 | 51 | 17 | 85 | 15 |
| 17 | 17 | 255 | 51 | 15 |
| 255 | 255 | 51 | 51 | 15 |
| 17 | 17 | 17 | 85 | 15 |

TABLE 2

| Corresponding Processed image file | | | | |
|---|---|---|---|---|
| 1 | 5 | 15 | 3 | 17 |
| 15 | 15 | 1 | 5 | 17 |
| 1 | 1 | 5 | 5 | 17 |
| 15 | 15 | 15 | 3 | 17 |

The driver receives the necessary information and translates it into pulses with required voltage, amplitude and time and addresses each nozzle with a series of pulses as required.

The information is typically delivered to the printer from the PC by means of a USB connection, say an 8 Mbps serial link. The driver deploys serial information with the help of shift registers. The shift registers function as low voltage serial to high voltage parallel converters with push-pull outputs. The host supplies a number of bytes for each nozzle, where the number defines the number of drops the nozzle is required to shoot.

The driving electronics within the printer is preferably responsible for addressing the various ink jet nozzles and sending the above-described voltage pulse that in its turn ejects the drop, based on the print file matrix prepared in the supervising computer. In order to create half tone dots as described, the driver may send a series of pulses to the ink jet nozzle. A corresponding series of drops are ejected so that the desired amount of ink lands on the print medium so as to define a half tone dot. Consequently, the driver produced pulse series creates the half tone dots.

In order to make use of the serial to parallel converters described above with respect to FIG. 26, additional logic is required. The printer's on-board field-programmable gate array (FPGA) preferably controls the shift register data load, definition of pulse amplitude and pulse duration.

The series of pulses preferably reaches the nozzles from the driver using the matrix address method referred to above.

The matrix address method selects, meaning turns on or off, the individual ink jet nozzles in the same way that a pixel is activated in a 2-D graphic screen display. In the addressing method, the resistor, comprising the ink ejector in each nozzle, is connected through its two poles to wires of two axes around the print head. When a voltage pulse is applied to the two wires, an electrical circuit is closed and the specific resistor is heated up. A corresponding arrangement is made for any other kind of ink expulsion device.

The wires of the matrix are preferably connected to pin connectors on the edges of the matrix, through which the matrix is connected to the printed circuit board (PCB) driver.

Continuous Printing with a Matrix Cylinder System.

Reference is now made to FIG. 28, which is a simplified diagram showing a paper feed and printing system according to a further preferred embodiment of the present invention. FIG. 28 shows a printing cylinder 300, in which print nozzles are inserted. Paper 302 is fed around the printing cylinder 300 from the outside and the nozzles shoot jets of ink outwardly. In use the cylinder rotates with the same angular velocity as the paper so that the paper and the cylinder are relatively stationary.

In the preceding embodiments, with the 2-D full array matrix of ink jet nozzles, printing takes place when the matrix is stationary relative to the print medium. While this absence of motion presents advantages in print quality as described hereinabove, it serves as a constraint on the paper feed and the overall print sequence. The paper (or other print medium) is fed into the print system, but then has to be stopped from its movement to allow the ink jet matrix to print. At the end of the printing process the paper has to be put back into motion to be taken out from the printer. The requirement to stop the paper clearly slows the paper feed and the entire printing. The embodiment of FIG. 28 increases the printing speed, by permitting a continuous motion of the paper. In the embodiment of FIG. 28 the paper does not need to be brought to a halt, yet the embodiment still makes use of the principal that there is no motion between the paper and the ink jet matrix array.

As explained, the embodiment of FIG. 28 combines continuous paper-feed, and the absence of relative motion between the printing array and the printed media. The combination of continuous paper feed and absence of motion between the array and the paper or print media is achieved by the use of a cylinder shaped array 30 of ink jet nozzles. The cylinder array has most of the characteristics that the 2-D full array that was described before has. The main difference between them is in the shape; the 2-D full array is simply rolled to form the cylinder. The print medium is brought to the cylinder in such a way that it revolves in an equivalent of geo-stationary orbit over a part of the cylinder—with angular velocity equal to that of the cylinder. In the geo-stationary rotation the ink jet nozzles are situated above a constant point over the print medium in the same way that communication satellites remain above a constant point of the earth. It is noted that both continuous paper and separate sheets may be used.

In FIG. 28, the cylinder's angular velocity is $\omega$ [rad/sec] and t [s] is the time. A profile view of the cylinder and the paper is seen in in FIG. 28. It can be seen that a point on the cylinder and a point on the paper are coincident at all times due to equal angular velocity of paper and cylinder (for example: 0, $0.5\pi/\omega$, $\pi/\omega$). FIG. 29 is a perspective view from the side of the paper rotating about the cylinder.

In using a rotating cylinder, account is preferably taken of the effect of the rotation on pressure in the ink. In order to obtain fast printing, the cylinder must rotate at a high angular velocity, resulting in centripetal force on the ink towards the outside. The centripetal force increases the pressure of the ink. Therefore the design of the reservoirs has to be modified to strength the capillary force towards the center so that a suitable pressure remains despite the additional centripetal force. The centripetal angular acceleration equation is $$a = \frac{v^2}{r}$$

When using the rotating cylinder, the acceleration a needs to be added vectorially to the gravity constant g in all the pressure calculations to give a total overall acceleration.

A further point to be taken into consideration is the ink supply. The ink in the rotating cylinder configuration is preferably supplied from the axis of the cylinder. The ink can be delivered in two different ways:

1. The centripetal effect can be used to power the ink supply. The ink is delivered from a static location to a rotating location on the axis. The centripetal force then distributes the ink outside to the cylinder surface.

2. A static wiper can be positioned so as to touch the cylinder from the inside. Since the cylinder rotates continuously, the static wiper continuously wipes the printing array and delivers the ink to the planar wiper. The wiper is similar to that in the previous static planar embodiments. The difference here is that while in the planar arrangement the printing array is static and the wiper moves, in the cylindrical arrangement the opposite applies. The wiper is static and the printing array moves.

It is noted that Coriolis forces affect the flow of the ink from the central axis to the paper. However the effect is very minor compared to the other forces.

A constant ink pressure in a micro reservoir—Micro reservoir shape Reference is now made to FIG. 30, which is a simplified diagram illustrating a further preferred embodiment of a construction of a micro reservoir. A micro reservoir 140 is broadly cylindrically shaped, that is having a round cross section but flat upper and lower ends 142 and 144 respectively. The upper end 142 is relatively wide and the lower end 144 is relatively narrow and a concave contour 146 connects therebetween. The derivation of the contour is described hereinbelow.

A problem arises in that, in any regular shape of reservoir, the pressure at the bottom of the reservoir changes as the ink level rises or falls in the reservoir, due to the weight of the liquid above, that is gravitational pressure=g*h*P, where h is the level of ink, P is the specific gravity of the liquid and g is the gravitational constant.

For good drop ejection, a constant pressure is preferable. Such constant pressure is achieved in regular cartridges as described in Patent Application No. US2001012039. This constant or as near as possible constant pressure, is also desired in the present embodiment. However, due to the different printing implementation, the solution of the above-mentioned application is not directly applicable, as is now explained.

In the system used in the cited application, all of the ink system is connected, and applying pressure to the ink can be achieved using springs or other such means. By contrast, in the present embodiments ink supply is based on separation in the ink system. That is to say all the reservoirs are separated from each other. Accordingly, delivering and regulating pressure by the ink using the systems of the above citation is not possible.

One way to deliver pressure comprises placing the entire array in a regulated pressure chamber. In this way all the reservoirs theoretically have the same pressure on the ink surface, but in practice this is difficult to achieve. For example the ink level is not necessarily the same in all the reservoirs.

The solution shown in FIG. 30 is now explained. The aim is to obtain a constant pressure in the reservoirs, even while not equally filled. This is substantially achieved by ensuring that the equality between the weight of the ink and the capillary force can be kept at different ink levels in the micro reservoir. The ink level naturally, changes when ink is ejected from the nozzles.

The equation that describe the relations between the weight and the capillary force is:

$$V(h)Pg=S\cos(\theta)L(h)$$

where:

h=height level of ink

V(h)=volume of ink as function of h

P=specific gravity of the ink;

g=gravity constant

L(h)=length of contact between the ink and the walls of the micro-reservoir as function of h;

S=fluid constant of surface tension force, which as will be appreciated, is made up of adhesive and cohesive forces;

θ=contact angle.

Based on the above equation, we disclose a method for obtaining a reservoir that maintains a constant pressure for variable ink level. A shape is found which allows the surface tension forces to compensate for the additional weight. The shape is a property of any given ink and given wall material. To solve the problem we suggest a micro reservoir with a circular cross section for example. It is noted that similar mathematics can be performed for other cross-sections. The equation relates to a variable R(h), which is a radius which is a function of the variable h, height, that in other words changes at different levels (h) in the reservoir.

Solving for such a variable yields an integral equation of the form:

$$\pi Pg\int_0^h R^2(h)dh = S\cos(\theta)2\pi R(h)\sin\left[\arctan\left(\frac{dR(h)}{dh}\right)\right]$$

A numeric solution for R(h) to this equation yields the shape of the reservoir as shown in FIG. 30. It will be appreciated that FIG. 30 is merely illustrative and does not indicate an exact solution.

Satisfying this relation yields a reservoir that has a constant pressure irrespective of varying ink levels.

An analytic approximation of the solution can be obtained by neglecting the dependence of the force projection angle arctan $$\left(\frac{dR(h)}{dh}\right)$$

as follows:

$$-(S*2/P*g)(1/R)=h+\text{constant}$$

Designing a reservoir according to the analytic solution results in a reservoir that has an approximately constant pressure for varying ink levels.

Print Algorithm (or Print Sequence).

As described hereinabove, in order to achieve the half tone dots on the print medium, there is a need to eject a suitable number of ink drops from the same nozzle to a single point on the print medium. In the preceding embodiments, a matrix addressing method is used to switch the nozzles. In a further preferred embodiment there is provided a switching algorithm (or sequence) that carries out printing in a minimal amount of printing time.

Now, consider that if the entire half tone dot is printed in serial manner, i.e. the switching of the nozzles is one nozzle after the other—each addressed nozzle receives a series of electrical pulses and ejects a series of drops to create the specific half-tone dot. Only at the end of the series of pulses or drops the addressing begins to address the next nozzle.

In this case the overall printing time becomes:

$$\sum_{i=0}^{M} d(i)*(1/f)$$

where M is the total number of nozzles, d(i) is the number of drops that the i-th nozzle fires and f is the firing frequency of the drops.

This sum is eventually equal to the total number of drops ejected from the entire matrix multiplied by 1/f:

(Total number of drops)*(1/f)

For example, if the number of nozzles is 500000 and each nozzle fires 10 drops at firing frequency of 10 KHz then the printing time will be: 5000000/10000=500 seconds. Obviously an enormous amount of time in terms of printing a page.

Now consider the following improved sequence. Such a better sequence may involve switching an entire row rather than a pixel. i.e. all the required nozzles in the row operate simultaneously and deliver the amount of required drops. Only then the row may be switched off, and the next row can be switched. Such an improved sequence indeed shortens the printing time, but the printing time remains unacceptably long:

(total number of rows)*d(max)*(1/f)

where d(max) is the number of drops needed to create the largest half tone dot in any given row.

For example, if the number of rows is 500 and d(max)=100 and f=10 KHz then the overall printing time is:

500*100/10000=5 second, which is still a long time for printing a single sheet(although just within the bounds of acceptability in the existing art).

It is noted that, in these two switching examples, the firing frequency of the nozzles has to be very high because the overall printing time depends directly thereon. It is, however, well known that firing drops at high frequencies becomes more complicated then firing at low frequency and is more likely to cause misfiring problems. Therefore a lower firing frequency is preferable. However, in the present lo example in common with the prior art, the firing frequency cannot be decreased significantly due to the dependence of the printing time on the firing frequency. If the present embodiments are to enable printing in a significantly shorter time then the present art, there is a need for a printing algorithm in which the firing frequency does not impose a limitation on the printing time. That is to say a rapid printing time can be achieved independently of the firing frequency.

Reference is now made to FIG. 31, which is a simplified flow chart that illustrates an improved switching algorithm (or sequence) for solving the above problems in that it enables high speed printing using the printing matrix or cylinder of the present invention without the printing speed being directly affected by the firing frequency.

The preferred embodiment comprises a switching sequence that prints half tone dots in parallel. The addressing performs addressing scans in which the rows are switched one after the other. During the addressing of an individual row, one drop is fired from each of the nozzles (where a dot is required at all) and not the entire number of drops that create the half-tone dot in the row. After completing a scan of all the rows another scan is preformed for the next dot. That is to say certain printing positions may require no dots, others one dot and others ten dots. There is thus an overall sequence which comprises three loops, an innermost row loop, an intermediate matrix loop and an outermost overall loop. The innermost loop is the above described addressing of an individual row that ejects single dots in parallel from each of the nozzles of the row that currently need a dot. The intermediate loop is a loop that switches sequentially through all of the rows in the matrix that still need a dot to be printed.

The outermost loop is a loop that switches between dots. In this outermost loop a first scan of the rows of the matrix is carried out for a first half tone dot. A second scan of the rows of the matrix is carried out to fire nozzles at any point where a second half tone dot is needed, and so on until all dots have been printed. It will be appreciated that the later scans become progressively quicker as fewer and fewer locations require the higher numbers of dots, and any row that does not require the given number of dots is simply passed over in the scan.

In each row scan only one drop is fired from each nozzle. Each nozzle has to fire the total number of drops in order to create its specific half-tone dot. If, for example, a nozzle needs to fire 5 drops, then it will fire one drop in each switching scan until the $5^{th}$ scan, then it stops firing drops. Thus the number of scans is the number of the maximal drops needed for the half-tone anywhere on the current sheet, so if the darkest point on the sheet requires ten dots then ten scans of the matrix are carried out, but the last scan encompasses only those rows needing ten dots.

In the present technique the time interval between two drops from the same nozzle is exploited for the remaining rows, that is to deliver drops in other rows. Hence the nozzle refresh time, the time taken to replenish the nozzle with ink does not have to be included and the overall printing time is significantly reduced. Specifically the printing time is not dependent on how long it takes to refresh the nozzle, which is a major constraint on the firing frequency.

The scan order can be the physical order of the lines or in a preferred embodiment, the lines can be scanned in a logical order which is selected so that successive lines are not fed from the same micro-reservoir. In an alternative embodiment the sizes of the drops can be altered.

In the switching sequence of FIG. 31, the overall printing time is: (number of rows)*(total number of scans)*(the switching time from one row to the other).

Using the same values as in the last example:

500 rows and 100 scans (max number of drops), and with a switching time of 10 μs (resulting from a typical firing pulse duration of ~10 μs) which corresponds only to a 200 Hz firing frequency in the same nozzle, rather than 10 KHz in the previous example, the overall printing time for a full sheet is: $500*100*(10*10^{-6})=0.5$ second.

It is further noted that the printing matrix can be divided into sub-matrices. Each sub-matrix can be controlled separately in the way described above to further reduce the overall printing time.

A clear advantage of this technique is that the firing frequency is no longer a limiting factor to the printing time and it can be drastically reduced. Therefore the nozzles requirements can also be reduced while printing performance is improved. Also, the lifetime of each nozzle is improved due to its operation at a lower firing frequency. The use of the embodiment of FIG. 31 thus increases the usefulness of the matrix or cylinder of the present embodiments.

Print medium feed structure device & maintenance for the nozzle matrix. Reference is now made to FIGS. 32 and 33, which are front and side views respectively of an embodiment including a construction for the printing region around the matrix which is optimized to reduce the extent of drying whilst ink lies in the reservoir. In FIG. 32, an enclosure 50 houses the matrix and the print medium. An entry slit 52 allows entry of a print medium into the printing region and an exit slit 54 allows for exit of the print medium therefrom. The enclosure is not actually airtight but close to airtight and ensures that evaporation is controlled. In a further preferred embodiment the slits may actually be closed when printing does not take place, in fact rendering the printing region substantially airtight. Thus there is defined a printing state and a maintenance or shutdown state in between printing, such that the slits are sealed in the maintenance state. In the printing state, the print medium is fed into the printer through slit 52 into a gap between the nozzle matrix and bed 56 on which the paper is lying. Following printing, the paper is taken out of the printer, through slit 54. In an alternative embodiment a single slit may be used for both.

In the dormant or maintenance state, shutters close the slits in order to seal the nozzle matrix so that the space between the nozzle matrix and the medium bed is completely sealed from the surrounding environment, thereby preventing the ink from drying, despite the fact that the micro reservoirs are open to atmospheric pressure.

It is well known that in drop on demand ink jet technology there is a need to maintain the ink jet nozzles. The issue is described in U.S. Pat. No 5,339,102, which is hereby incorporated herein by reference.

Generally, in ink jet printers there is a maintenance station in one side of the printer away from the print zone of the print head. During a maintenance state, the print head is moved to the maintenance station, where it is sealed with a cap. Such sealing keeps the ink in the nozzles from drying. In the station, a maintenance wipe is also performed in order to remove unwanted ink residues from the region of the nozzles.

Now, in the matrix printer of FIG. 32, the print medium is fed into a bed where it lies stationary whilst printing occurs. The print medium is fed into the printer through feed slit 52 and after the printing is completed it is taken out through feed out slit 54. The space between the nozzles and the medium bed is completely sealed except for the slits so that after closing the slits and ensuring that they are sealed, there is a complete seal of the enclosed space from the surrounding environment The seal ensures that the ink in the matrix orifices does not dry. Moreover, in order to further ensure that the ink does not dry it is possible to cause a saturation of ink vapors inside the closed space by feeding a print medium sheet that stays inside the printer when entering the maintenance state and to print on it. Now since the print medium is in a closed volume, the ink vapors that are on it vaporize into the closed air until it becomes substantially saturated with vapor. Such saturation ensures that the ink in the nozzles or micro reservoirs does not dry. The controlled environment which is created within the enclosure ensures a substantially defined humidity.

When the printer now enters the print state, the printer performs a "prime firing" on the medium sheet that was inside during maintenance and then it is fed out to be discarded.

In a matrix printer where the ink supply is performed using a wiper, as in some of the embodiments hereinabove, an additional wiper may be connected to the ink supply mechanism. The additional wiper is located on the opposite side of the ink supply wiper, on the nozzle plate, so that when ink supply is performed it wipes the ink jet nozzles of unwanted ink residues.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. An ink jet print head comprising a print head matrix, the matrix having a plurality of nozzles for bubble formation and expulsion, said nozzles opening onto a print side surface of said matrix, the matrix further comprising a plurality of local reservoirs, wherein each of said local reservoirs is configured to supply ink to nearby ones of said nozzles at atmospheric pressure by capillary action, wherein said capillary action is unaided by compression, said local reservoirs opening onto an ink supply surface of said matrix and such that each one of said local ink detaining storage reservoirs supplies ink from said ink supply surface to a single respective one of said nozzles wherein said matrix is arranged into a substantially rectangular printing area dimensioned to give simultaneous printing coverage of standard sized printing media upon being placed substantially over said standard sized printing media, and arranged for said printing on said standard sized printing media during a period of unchanged relative displacement between said print head and said printing media.

2. The ink jet print head of claim 1, wherein said print side surface and said ink supply surface are respectively opposite sides of said matrix.

3. The ink jet print head of claim 1, further comprising an ink distribution device associated with said ink supply surface for distributing ink to reach said local ink reservoirs.

4. The ink jet print head of claim 3, wherein said ink distribution device is a tubeless distribution device.

5. An ink jet printing head comprising a plurality of nozzles for forming and expelling ink droplets for printing onto a print medium, wherein the plurality of nozzles is arranged into a two dimensional grid substantially to be coextensive with a standard size print medium, such that said nozzles extend in two dimensions, the ink jet printing head further comprising a plurality of local ink-detaining reservoirs extending with said nozzles, each of said local reservoirs being configured to supply ink to corresponding ones of said nozzles by capillary action at atmospheric pressure, said capillary action not assisted by compression.

6. An ink jet print head comprising a two dimensional print head matrix, the matrix having a plurality of nozzles extending along said respective two dimensions of said matrix for bubble formation and expulsion, said nozzles opening onto a print side surface of said matrix, the print head matrix further comprising a plurality of local reservoirs coextensive with said nozzles, wherein each of said local reservoirs is configured to supply ink to corresponding ones of said nozzles at atmospheric pressure by capillary action, said local reservoirs opening onto an ink supply surface of said matrix such that ink is passed from said ink supply surface via said reservoirs to respectively corresponding nozzles, a passage from a reservoir to a corresponding nozzle being by said capillary action, wherein said capillary action is unaided by compression.

* * * * *